US012350569B2

(12) United States Patent
Taylor

(10) Patent No.: US 12,350,569 B2
(45) Date of Patent: Jul. 8, 2025

(54) PORTABLE PUTTING GREEN

(71) Applicant: IDEASTREAM CONSUMER PRODUCTS, LLC, Walpole, MA (US)

(72) Inventor: Curtis Taylor, Chagrin Falls, OH (US)

(73) Assignee: Brands to Retail, LLC, Cleveland, OH (US)

( * ) Notice: Subject to any disclaimer, the term of this patent is extended or adjusted under 35 U.S.C. 154(b) by 299 days.

(21) Appl. No.: 18/099,714

(22) Filed: Jan. 20, 2023

(65) Prior Publication Data

US 2023/0226425 A1 Jul. 20, 2023

Related U.S. Application Data

(60) Provisional application No. 63/301,226, filed on Jan. 20, 2022.

(51) Int. Cl.
*A63B 69/36* (2006.01)

(52) U.S. Cl.
CPC ..... *A63B 69/3676* (2013.01); *A63B 69/3661* (2013.01)

(58) Field of Classification Search
CPC ..... A63B 69/3676; A63B 69/3661; A63B 2067/025; A63B 2071/0694; A63B 2210/50
USPC ..... 473/150–196, 278
See application file for complete search history.

(56) References Cited

U.S. PATENT DOCUMENTS 2,057,504 A * 10/1936 Schafer ..... A63B 67/02 473/162
2,460,080 A * 1/1949 Gerding ..... A63B 57/357 473/185
3,275,325 A * 9/1966 MacKenzie ..... A63B 57/405 273/125 R
3,540,733 A * 11/1970 Lamattina ..... A63B 67/02 473/183
5,102,141 A * 4/1992 Jordan ..... A63B 67/02 473/163
5,431,403 A * 7/1995 Pelz ..... A63B 69/3676 473/160
7,137,900 B1 * 11/2006 Van Dyke ..... A63B 69/3661 473/157
7,556,566 B2 * 7/2009 Shin ..... A63B 69/3661 473/162

* cited by examiner

*Primary Examiner* — Nini F Legesse
(74) *Attorney, Agent, or Firm* — Pearl Cohen Zedek Latzer Baratz, LLP

(57) ABSTRACT

A practice putting device that includes a rollable putting mat, a housing, and ball return arrangement.

27 Claims, 13 Drawing Sheets

PORTABLE PUTTING GREEN

REFERENCE TO RELATED APPLICATIONS

The present disclosure claims priority on U.S. Provisional Application Ser. No. 63/301,226 filed Jan. 20, 2022, which is incorporated herein.

TECHNICAL FIELD

The disclosure relates generally to golfing devices, and more particularly to a portable putting device. The portable putting device includes a putting mat that can be wound up in a roll to be stored on a housing and can be unwound from the housing for use as a putting surface, and wherein the housing functions as a device that the mat can be rolled and unrolled therefrom, and the housing also functions as a target for a user to practice the accuracy of puts.

BACKGROUND OF DISCLOSURE

There are known putting practice devices which are constructed so that a mat is rolled and is then stored in a vinyl or fabric bag or in a box-shaped case. Such putting practice devices are disadvantageous in that the mat simply has the shape of a long flat sheet. These devices are typically inconvenient to store and assemble and typically require the user to retrieve the golf balls after being putted. Some of these devices also include guardrails on the side of the mat to prevent the golf ball from leaving the mat. However, such mats are generally difficult to roll up and store and the guardrail commonly becomes damaged after the mat has been rolled up multiple times.

In view of the current state of the art of practice putting devices, there is a need for a practice putting device that is easy to store and assembly for use, which does not damage the mat after multiple storages, and has a ball return arrangement that does not require the user to retrieve a golf ball after each put.

SUMMARY OF THE DISCLOSURE

The present disclosure overcome the past deficiencies of prior art portable putting green devices by disclosing a practice putting device that is easy to store and assembly for use, which does not damage the putting mat after multiple storages, and has a ball return arrangement that does not require the user to retrieve a golf ball after each put.

In one non-limiting aspect of the present disclosure, there is provided a practice putting device in accordance with the present disclosure includes a rollable putting mat, a housing, and ball return arrangement. The putting mat can be formed of any type of flexible material (e.g., fabric, plastic, rubber, polyurethane foam, PVC, etc.). The putting mat is configured to be rolled and unroller multiples times without damaging the putting mat. The housing can be formed of any durable material (e.g., metal, plastic, wood, composite material, fiber reinforced material, etc.) and include any color.

In another non-limiting aspect of the present disclosure, there is provided a putting mat is generally formed of a material that has little or no memory so that after the putting mat is unrolled, the putting mat lays flat on a flat floor surface. The length and width of the putting mat is non-limiting. In one non-limiting embodiment, the length of the putting mat is generally 3-15 feet (and all values and ranges therebetween), and typically 4-10 feet. In another non-limiting embodiment, the width of the putting mat is generally 0.4-3 feet (and all values and ranges therebetween), and typically 0.5-1.5 feet. The thickness of the putting mat is generally 0.05-0.75 inches (and all values and ranges therebetween), and typically 01-0.4 inches. The thickness and material used to form the putting mat is generally selected so that the putting mat can be easily rolled on the housing and unrolled from the housing. Generally, the thickness along the 70-100% of the longitudinal length (and all values and ranges therebetween) of the putting mat and 70-100% of the width (and all values and ranges therebetween) of the putting mat remains constant; however, this is not required. In one non-limiting embodiment, the thickness along the 85-100% of the longitudinal length of the putting mat and 85-100% of the width of the putting mat remains constant. In another non-limiting embodiment, the longitudinal sides along the longitudinal length of the putting mat are generally parallel to one another along 70-100% of the longitudinal length (and all values and ranges therebetween) of the putting mat. In another non-limiting embodiment, the longitudinal sides along the longitudinal length of the putting mat are generally parallel to one another along 85-100% of the longitudinal length of the putting mat. In non-limiting embodiment, the thickness of the putting mat along the longitudinal length of the putting mat is generally constant along 70-100% of the longitudinal length (and all values and ranges therebetween) of the putting mat. In non-limiting embodiment, the thickness of the putting mat along the longitudinal length of the putting mat is generally constant along 85-100% of the longitudinal length of the putting mat.

In another non-limiting aspect of the present disclosure, there is provided a putting mat wherein the top surface of the putting mat can optionally include a texture that simulates the surface of a putting green. In another non-limiting embodiment, the top surface of the putting mat can optionally include one or more colors, images, designs, etc. to enhance the visual appeal of the putting mat. For example, the top surface of the putting mat can include one or more bright colors, images of superheroes, animals, cartoon figures, etc. to appeal to a younger user. In another example, the top of the putting mat can include college colors and/or emblems, names of famous golf courses, names of famous gold players, emblems or other symbols of famous golf courses, etc. to appear to various users.

In another non-limiting aspect of the present disclosure, there is provided a putting mat wherein the top surface of the putting mat can optionally include markings to provide information to the user when practice putting. Such marking can include distance markings, one or more lines along the longitudinal length of the putting mat to inform a user how straight the putted golf ball travels along the putting mat, markings to indicate one or more targets on the putting mat, etc. In one non-limiting embodiment, the top surface includes one or more of the following markings: a) distance markings and/or numbering to indicate the distance from the golf hole opening at the end portion of the putting mat, b) two parallel lines that are equal spaced from the center longitudinal axis of the putting mat, and/or c) a center line along the center longitudinal axis of the putting mat. In one non-limiting embodiment, the putting mat includes multiple distance markings. Such distance marks can include numeric marking and/or line markings. In one non-limiting arrangement, numeric markings (e.g., 1, 2, 3, etc.) are located on one or both side edge portions of the putting mat that indicates the distance in feet, meters, and/or inches the distance of the mat from the golf hole opening. In another non-limiting arrangement, line markings are located on one or both side edge portions of the putting mat that indicate the distance in feet, meters, and/or inches the distance on the mat from the golf hole opening.

In another non-limiting aspect of the present disclosure, there is provided a putting mat wherein the front-end portion of the putting mat can optionally include a weighted device secured to the putting mat to facilitate in maintaining the flatness of the putting mat after being unrolled from the housing and/or to maintain the front portion of the putting mat flat on a floor surface after the putting mat is unrolled from the housing. In one non-limiting embodiment, the weighted device can be a metal, plastic, composite device that is secure to the front edge of the putting mat. The weighted device can be formed of one or more pieces and generally has a total length that extends 60-100% of the width (and all values and ranges therebetween) of the putting mat. In another non-limiting embodiment, the weighted device is formed of a different material from the putting mat. In another non-limiting embodiment, the weighted device can be connected to the putting mat by adhesive, clamp arrangement, melted seam, etc. The weighted device generally has a length along the longitudinal axis of the putting mat that is no more than 10% (e.g., 0.0001-10% and all values and ranges therebetween) of the longitudinal length of the putting mat, typically the weighted device generally has a length along the longitudinal axis of the putting mat that is less than 5% of the longitudinal length of the putting mat, more typically 0.0001-2% (and all values and ranges therebetween) of the longitudinal length of the putting mat. In another non-limiting embodiment, the weighted device can optionally include a connection arrangement (e.g., adhesive strip, hook and loop fastener, etc.) on the bottom surface of the weighted device to facilitate in releasably securing the bottom surface of the weighted device to a floor surface (e.g., carpet, tile floor, wood floor, ceramic floor, vinyl floor, etc.). In another non-limiting embodiment, the weighted device can include a size that allows at least a portion of the top surface of the weighted device can support golf balls prior to the placing of the golf balls on the putting mat for practice putting. In another non-limiting embodiment, the top surface of the weighted device can optionally include one or more connectors (e.g., adhesive strip, hook and loop fastener, snap, etc.) that can be used to releasably connect the weighted device to the bottom surface of the putting mat when the putting mat is rolled onto the housing.

In another non-limiting aspect of the present disclosure, there is provided a practice putting device wherein the housing is configured to enable the putting mat to be rolled about a portion of the housing so that the putting mat can be stored on the housing. Generally, one end of the putting mat is connected to the housing. The putting mat can be permanently or removable connected to the housing. The size and materials of the housing are non-limiting. Generally, the housing has a maximum width of 5-20 inches (and all values and ranges therebetween). Generally, the housing has a size, shape and weight that makes is easily portable by an individual (e.g., can be lifted and carried by a single hand of a user). Generally, the weight of the housing is less than 20 lbs. (e.g., 0.5-20 lbs. and all values and ranges therebetween), and typically 0.5-5 lbs. Generally, the volume of the housing is less than 6500 in.$^3$ (e.g., 10-6500 in.$^3$ and all values and ranges therebetween), and typically 10-1000 in.$^3$.

In another non-limiting aspect of the present disclosure, there is provided a practice putting device wherein the housing includes a midportion, a first end portion connected to one side of the midportion and second end portion connected to the opposite side of the midportion. The maximum cross-sectional area of the midportion is generally less than the cross-sectional area of one or both the first and second portions. The midportion can be configured to be spaced from a floor surface when the housing is positioned on the floor surface and the putting mat is fully unrolled from the housing. Generally, the midportion is spaced at least 0.1 inches (e.g., 0.1-5 inches and all values and ranges therebetween) from the floor surface when the housing is positioned on the floor surface and the putting mat is fully unrolled from the housing. In another non-limiting embodiment, the midportion include one or two arcuate landings that are located above and/or rearwardly of the location that the putting mat is connected to the midportion, and wherein the one or two arcuate landings are used to facilitate in the winding of the putting mat about the midportion when the putting mat is rolled up onto the housing. When the midportion includes two arcuate landings, the arcuate landing can have the same shape and/or size. In one-non-limiting arrangement, the width of the arcuate landing is at least 0.1 inches (e.g., 0.1-5 inches and all values and ranges therebetween), and typically 0.2-1.5 inches. Each of the arcuate landing extends inwardly from the side of the midportion. The arcuate landings generally have a constant radius of curvature; however, this is not required. In another non-limiting embodiment, the arcuate landings generally to not fully encircle the central axis of the midportion. In one non-limiting arrangement, the one or two arcuate landings encircle 10-90% (and all values and ranges therebetween) of the central axis of the midportion, and typically encircles 40-90% of the central axis of the midportion. In another non-limiting embodiment, the midportion includes an arcuate rear flange that extends to and between the two interior sides of the midportion, or to the one or two arcuate landings. The arcuate rear flange can be used to facilitate in the winding of the putting mat about the midportion when the putting mat is rolled up onto the housing. The arcuate rear flange can be connected to the one or two arcuate landings when used. As with the arcuate landings, the arcuate rear flange can be spaced from the putting mat when the putting mat is fully unrolled from the housing. In another non-limiting embodiment, the radius of curvature of the arcuate rear flange can optionally be the same as the radius of curvature of the one or two arcuate landings. In another nonlimiting embodiment, the arcuate rear flange and/or the one or two arcuate landings are spaced downwardly (e.g., spaced downwardly 0.25-5 inches and all values and ranges therebetween) from the outer edge of the first and second end portions; however, this is not required. In another non-limiting embodiment, when the putting mat is wrapped about the midportion and is fully rolled-up, 60-100% (and all values and ranges therebetween) of the rolled-up putting mat is located between the first and second end portions, and typically 80-100% of the rolled-up putting mat is located between the first and second end portions.

In another non-limiting aspect of the present disclosure, there is provided a practice putting device wherein the midportion of the housing includes a flat mount surface wherein an end portion of the putting mat is supported thereon when secured to the housing. In one non-limiting embodiment, the end portion of the putting matt can be permanently connected or removably connected to the flat mat mount and/or other portion of the housing. The type of connection is non-limiting (e.g., adhesive, clamp arrangement, screws, rivet, staples, etc.). The flat mount surface generally has a width that extends 80-100% (and all values and ranges therebetween) the width of the midportion. In one non-limiting arrangement, the sides of the flat mount surface are connected to the inner side surface of the midportion. In another non-limiting embodiment, the flat mount surface includes an opening that is configured to allow a golf ball to pass therethrough. When the putting mat is secured to the housing the opening in the putting mat overlies and/or encircles the opening in the flat mount surface. As can be appreciated, the size and/or shape of the opening in the putting mat and the opening in the flat mount surface can be the same; however, this is not required. In one non-limiting embodiment, the opening in the putting mat and/or the flat mount surface is configured to receive a golf ball. The opening can be designed as a target for a user when putting. The opening can optionally be used to allow a golf ball that passes through to pass into the ball well. In another non-limiting embodiment, the back end of the putting mat and/or the back end of the flat mount surface can form a rear a ball ledge that allows a ball that rolls past the ball ledge to optionally fall into the ball well. In another non-limiting embodiment, the flat mount surface can be spaced from the arcuate rear flange such that a golf ball can drop between the back end of the flat mount surface and an inner surface of the arcuate rear flange.

In another non-limiting aspect of the present disclosure, there is provided a practice putting device wherein the end portions have a generally circular or oval shape so that the housing can be rolled on a floor surface; however, other shapes can be used.

In another non-limiting aspect of the present disclosure, there is provided a practice putting device wherein one or both of the end portions on the housing can optionally include a floor orientation arrangement that facilitates in the proper orientation of the housing relative to the putting mat and floor once the putting mat is fully unrolled from the housing. Such floor orientation arrangement can be used to limit or prevent the rocking of the housing on a floor surface when the end portions have a circular or oval shape. The number and shape of the orientation arrangement is non-limiting. The orientation arrangement can be located on one or both of the end portions. In one non-limiting embodiment, the orientation arrangement includes a flat portion on an outer peripheral surface on one or both of the end portions. In another non-limiting embodiment, the orientation arrangement includes one or more protrusions extending outwardly from an outer peripheral surface on one or both of the end portions.

In another non-limiting aspect of the present disclosure, there is provided a practice putting device wherein the housing includes a ball well that is configured to receive a golf ball that has moved past the back end on the putting mat or a golf ball that has fallen through an optional golf ball opening that is located at or near the back-end portion of the putting mat. The ball well can be configured to retain golf balls that have fallen into the ball well, or the ball well can be configured to feed a ball that has fallen into the ball well to a ball return arrangement of the practice putting device. The configuration of the ball well is non-limiting. In one non-limiting embodiment, the arcuate rear flange forms all of a portion of the ball well. In another non-limiting embodiment, the bottom portion of the flat mount surface and the inner surface of the arcuate rear flange form 10-100% (and all values and ranges therebetween) for the surface of the ball well that is located below the back edge of the flat mount surface or the back-end portion of the putting mat. In one non-limiting embodiment, a portion of the arcuate rear flange is connected to the bottom surface of the fat mount surface; however, this is not required. In another non-limiting embodiment, the ball well can include a bottom sloped surface to cause a ball that has fallen into the well to roll away from the second end portion and toward the first end portion; however, this is not required.

In another non-limiting aspect of the present disclosure, there is provided a practice putting device wherein the putting mat mount on the housing includes a ball return arrangement that is configured to cause a golf ball that has moved onto the housing and/or into a ball well to be partially or fully returned to a user that is located at or near a front portion of the putting mat. In one non-limiting embodiment, the flat mount surface has an upward angled orientation when the putting mat is fully unrolled from the housing and the housing is properly situated on a floor surface. Such upward angled orientation causes the rear end portion of the putting mat that is positioned on and/or secured to the flat mount surface to also have an upward angled orientation when the putting mat is fully unrolled from the housing and the housing is properly situated on a floor surface. In such a configuration, when the golf ball is caused to roll partially up the angled end portion of the putting mat, but the golf ball does not pass through the opening in the putting mat or pass over the back end of the putting mat and fall into the ball well, the golf ball is caused to roll downwardly the sloped region of the putting mat by the force of gravity and to cause the golf ball to be partially or fully fed back to the front end of the putting mat. The angle of slope is non-limiting (e.g., 1-60° slope and all values and ranges therebetween).

In another non-limiting aspect of the present disclosure, there is provided a practice putting device wherein the housing includes a side ball return arrangement when the golf ball falls into the ball well (e.g., pass through the opening in the putting mat and falls into the ball well, the golf ball moves off the back end of the putting matt and into the ball well, etc.). In one non-limiting arrangement, the ball well is configured to capture all golf balls that pass through the opening in the putting mat and falls into the ball well, or the golf ball moves off the back end of the putting matt and into the ball well. As discussed above, the ball well can be partially or fully formed by the arcuate rear flange. The ball well can be configured to include one or more sloping surfaces at the base of the ball well and/or include one or more ramped and/or sloped structures in the base of the well to cause a golf ball that falls into the ball well to move toward one of the end portions and away from the other end portion. The angle of slope is non-limiting (e.g., 1-60° slope and all values and ranges therebetween). In one non-limiting arrangement, the ball well is configured to cause a golf ball that falls within the ball well to move toward the first end portion and away from the second end portion. In another non-limiting arrangement, the ball well includes a return opening that allows the golf ball to pass through the return opening and into the side ball return arrangement. In one non-limiting embodiment, the side ball return arrangement is configured to cause the golf ball to roll toward a user that is located at or near the front portion of the putting mat.

In another non-limiting aspect of the present disclosure, there is provided a practice putting device wherein the front-end portion of the side ball return arrangement is connected to one of the end portions of the housing. The front-end portion of the side ball return arrangement can be permanently connected or removably connected to the housing. The type of connection is non-limiting (e.g., adhesive, clamp arrangement, screws, rivet, staples, etc.). In one non-limiting embodiment, the front-end portion of the side ball return arrangement is connected to the first end portion of the housing. In such an arrangement, the housing includes a return opening that allows the golf ball to move from the ball well and into a portion of the first end portion and then onto the front portion of the side ball return arrangement. In another non-limiting embodiment, the front portion of the side ball return arrangement is elevated above a floor surface when the housing is positioned on the floor surface and the putting mat is fully unrolled from the housing. In one non-limiting arrangement, the golf ball, upon exiting the return opening and passing onto the front portion of the side ball return arrangement is elevated at least 0.5 inches (e.g., 0.5-10 inches and all values and ranges therebetween) above the floor surface when the housing is positioned on the floor surface and the putting mat is fully unrolled from the housing, and typically 2-5 inches above the floor surface when the housing is positioned on the floor surface and the putting mat is fully unrolled from the housing. In another non-limiting embodiment, the front-end portion of the side ball return arrangement forms a downward sloped ramped portion of the side return arrangement to cause the golf ball to roll downwardly toward the floor surface on the downward ramp portion. The angle of slope is non-limiting (e.g., 1-60° slope and all values and ranges therebetween). As the golf ball moves downwardly on the downward ramp portion, the golf ball increases in speed due to gravity. Once the golf ball rolls to the end of the downward ramp portion, the golf ball obtained sufficient speed to continue roll the partial of full remaining length of the side ball return arrangement.

In another non-limiting aspect of the present disclosure, there is provided a practice putting device wherein the side ball return arrangement includes a side return mat. In one non-limiting embodiment, the side return mat is generally made of a flexible material. In another non-limiting embodiment, the material of the side return mat can be the same as the putting mat; however, this is not required. In another non-limiting embodiment, the side return mat has a width that is less than the width of the putting mat. In one non-limiting arrangement, the width of the side return mat has a width that is at least 50% less (e.g., 50-95% less and all values and ranges therebetween) than a width of the putting mat, and typically 50-80% less than the width of the putting mat. In another non-limiting embodiment, the length of the side return mat can be the same or less than a length of the putting mat. In one non-limiting arrangement, the length of the side return mat is 75-120% (and all values and ranges therebetween) the length of the putting mat. In another non-limiting embodiment, the end of the side return mat can optionally include a side return mat weight and/or a ball stop; however, this is not required. In one non-limiting arrangement, the end of the side return mat optionally includes a ball stop to inhibit or prevent a golf ball from rolling off the back end of the of the side return mat. The configuration of the ball stop is non-limiting. In another non-limiting arrangement, the optional ball stop can include a sloped surface and/or raised surface to cause the ball to stop and/or an end bumper. The angle of slope is non-limiting (e.g., 1-60° slope and all values and ranges therebetween). In another non-limiting arrangement, the side return mat can optionally include a weight to facilitate in maintaining the end portion of the side return mat flat on a floor surface. The side return mat weight can be the same or similar to the weighted device that is optionally secured to the putting mat. In one non-limiting arrangement, the side return mat includes a ball stop and also functions as a side return weight. In such an arrangement, the ball stop is formed of a different material from the side return mat. In another non-limiting arrangement, the side return mat can optionally include a center groove and/or one or more side walls to facilitate in maintaining the golf ball on the side return mat as the golf ball rolls along the side return mat. In one non-limiting arrangement, the side return mat includes a first side wall or a first and second side wall that is used to facilitate in maintaining the golf ball on the side return mat as the golf ball rolls along the side return mat. In another non-limiting embodiment, the thickness of the side return mat can be greater, the same or less than the thickness of the putting mat. In one non-limiting arrangement, the thickness of the side return mat is less than (e.g., 5-80% less thick and all values and ranges therebetween) thickness of the putting mat. In another non-limiting embodiment, the side return mat can be a separate mat from the putting mat. In such an arrangement, the side return mat can be optionally releasably connected to the putting mat (e.g., hook and loop fastener, snaps, etc.). The side return mat can optionally include markings.

In another non-limiting aspect of the present disclosure, there is provided a practice putting device wherein the end portion of the housing that is connected to the side ball return arrangement optionally include a flange arrangement used to enable the side return mat to be roll on and unrolled from the end portion. In non-limiting embodiment, the side ball return arrangement is connected to the first end portion, and the first end portion includes first and second flanges. The spacing between the first and second flanges is the same as or greater than a width of the side return mat such that the side return mat can be easily rolled on to and rolled off the first end portion. In another non-limiting embodiment, when the side return mat is wrapped about the first end portion and is fully rolled-up, 60-100% (and all values and ranges therebetween) of the side return mat is located between the first and second flanges, and typically 80-100% of the rolled-up side return mat is located between the first and second flanges. In another non-limiting embodiment, when the putting mat and the side return mat are fully rolled up on the housing, the putting mat and the side return mat are spaced from one another. In another non-limiting embodiment, the end portion of the side return mat can optionally include one or more connectors (e.g., adhesive strip, hook and loop fastener, snap, etc.) that can be used to releasably connect the end portion of the side return mat to the bottom surface of the side return mat when the side return mat is rolled onto the housing.

In another non-limiting aspect of the present disclosure, there is provided a practice putting device wherein the practice putting device can optionally include one or more visual and/or audible devices to indicate a successful and/or unsuccessful put has occurred. Such visual and/or audible devices can include, but are not limited to, sound generator, light system, mechanical and/or motorized movement device that raises a flag or other indicator when the golf ball passes through the ball opening, etc.

In another non-limiting aspect of the present disclosure, there is provided a practice putting device wherein at least one of the end portions includes one or more golf ball slots and/or cavities that can be used to store one or more golf balls on one or both end portions. The configuration of the one or more golf ball slots and/or cavities, when used, is non-limiting. In one non-limiting arrangement, the one or more golf ball slots and/or cavities are located on the central region of the end portion and spaced inwardly from the outer side of the end portion.

None limiting features of the practice putting device include:

The putting mat rolls around the housing for compact, quick, and easy storage.

The roll of putting mat starts at the larger diameter of the midportion of the housing. In many prior art devices, the putting mat at the very end has a very tight and small diameter roll, thus causing the end of the putting mat to have a permanent curl from being wrapped so tight. The practice putting device of the present disclosure is designed to roll the putting mat so as to avoid such curling issues.

The putting mat includes a weighted device to ensure that the end of the putting mat lays flat on a floor surface.

The practice putting device can be setup simply by rolling it out, thus very little setup is required.

A mounted bubble level can be optionally used on the housing to indicate to a user whether the housing is sitting on flat, level on a ground surface.

A rollable return mat that is used to return a golf ball to the user.

A housing that includes a flange arrangement on the housing so that the return mat can be rolled up on the housing.

An optional ball switch that is configured to activate a light, cause a sound (e.g., bell, clapping, cheer, etc.), activate a counter, raise a flag, etc. when a golf ball passes through a ball hole in the housing.

Ball return arrangement has slopes and channels that capture the momentum of the moving golf ball to expedite the ejection of the golf ball from the housing and increase the speed that the golf ball moves down the side return mat.

One non-limiting object of the present disclosure is the provision of a portable practice putting device that is easy to store and assembly for use, which does not damage the putting mat after multiple storages, and has a ball return arrangement that does not require the user to retrieve a golf ball after each put.

In another and/or alternative non-limiting object of the present disclosure is the provision of a portable practice putting device that includes a rollable putting mat, a housing, and ball return arrangement.

In another and/or alternative non-limiting object of the present disclosure is the provision of a portable practice putting device wherein the putting mat is configured to be rolled and unroller multiples times without damaging the putting mat.

In another and/or alternative non-limiting object of the present disclosure is the provision of a portable practice putting device wherein the putting mat that has little or no memory so that after the putting mat is unrolled, the putting mat lays flat or substantially flat on a flat floor surface.

In another and/or alternative non-limiting object of the present disclosure is the provision of a portable practice putting device wherein a top surface of the putting mat can optionally include a) a texture that simulates the surface of a putting green, and/or b) one or more colors, images, designs, etc. to enhance the visual appeal of the putting mat.

In another and/or alternative non-limiting object of the present disclosure is the provision of a portable practice putting device wherein a top surface of the putting mat optionally include markings to provide information to the user when practice putting such as, but not limited to, a) distance markings and/or numbering to indicate the distance from the golf hole opening at the end portion of the putting mat, b) two parallel lines that are equal spaced from the center longitudinal axis of the putting mat, and/or c) a center line along the center longitudinal axis of the putting mat.

In another and/or alternative non-limiting object of the present disclosure is the provision of a portable practice putting device wherein a front-end portion of the putting mat can optionally include a weighted device secured to the putting mat to facilitate in maintaining the flatness of the putting mat after being unrolled from the housing and/or to maintain the front portion of the putting mat flat on a floor surface after the putting mat is unrolled from the housing.

In another and/or alternative non-limiting object of the present disclosure is the provision of a portable practice putting device wherein the putting mat and/or the weighted device can optionally include a connection arrangement (e.g., adhesive strip, hook and loop fastener, etc.) on the bottom surface of the putting mat and/or weighted device to facilitate in releasably securing the bottom surface of the putting mat and/or weighted device to a floor surface.

In another and/or alternative non-limiting object of the present disclosure is the provision of a portable practice putting device wherein a top surface of the weighted device can have a sufficient size and/or configuration to support golf balls prior to the placing of the golf balls on the putting mat for practice putting.

In another and/or alternative non-limiting object of the present disclosure is the provision of a portable practice putting device wherein the top surface of the putting mat and/or the weighted device can optionally include one or more connectors (e.g., adhesive strip, hook and loop fastener, snap, etc.) that can be used to releasably connect the top surface of the putting mat and/or the weighted device to the bottom surface of the putting mat when the putting mat is rolled onto the housing.

In another and/or alternative non-limiting object of the present disclosure is the provision of a portable practice putting device wherein the housing includes a midportion, a first end portion connected to one side of the midportion and second end portion connected to the opposite side of the midportion.

In another and/or alternative non-limiting object of the present disclosure is the provision of a portable practice putting device wherein the midportion includes one or two arcuate landings that are located above and/or rearwardly of the location that the putting mat is connected to the midportion, and wherein the one or two arcuate landings are used to facilitate in the winding of the putting mat about the midportion when the putting mat is rolled up onto the housing.

In another and/or alternative non-limiting object of the present disclosure is the provision of a portable practice putting device wherein the midportion includes an arcuate rear flange that extends between or to the two interior sides of the midportion, and/or extend between or to the one or two arcuate landings.

In another and/or alternative non-limiting object of the present disclosure is the provision of a portable practice putting device wherein the midportion includes an arcuate rear flange that can be used to facilitate in the winding of the putting mat about the midportion when the putting mat is rolled up onto the housing.

In another and/or alternative non-limiting object of the present disclosure is the provision of a portable practice putting device wherein the midportion includes an arcuate rear flange that can be spaced from the putting mat when the putting mat is fully unrolled from the housing.

In another and/or alternative non-limiting object of the present disclosure is the provision of a portable practice putting device wherein the midportion includes an arcuate rear flange that has a radius of curvature that can optionally be the same as the radius of curvature of the one or two arcuate landings.

In another and/or alternative non-limiting object of the present disclosure is the provision of a portable practice putting device wherein the midportion includes a flat mount surface and wherein an end portion of the putting mat is supported thereon when secured to the housing.

In another and/or alternative non-limiting object of the present disclosure is the provision of a portable practice putting device wherein the midportion includes a flat mount surface and wherein the end portion of the putting matt can be permanently connected or removably connected to the flat mat mount and/or other portion of the housing.

In another and/or alternative non-limiting object of the present disclosure is the provision of a portable practice putting device wherein the midportion includes a flat mount surface and wherein the sides of the flat mount surface are connected to the inner side surface of the midportion.

In another and/or alternative non-limiting object of the present disclosure is the provision of a portable practice putting device wherein the midportion includes a flat mount surface and wherein the flat mount surface includes an opening that is configured to allow a golf ball to pass therethrough.

In another and/or alternative non-limiting object of the present disclosure is the provision of a portable practice putting device wherein the midportion includes a flat mount surface and wherein the flat mount surface is spaced from the arcuate rear flange such that a golf ball can drop between the back end of the flat mount surface and an inner surface of the arcuate rear flange.

In another and/or alternative non-limiting object of the present disclosure is the provision of a portable practice putting device wherein the end portions have a generally circular or oval shape so that the housing can be rolled on a floor surface; however, other shapes can be used.

In another and/or alternative non-limiting object of the present disclosure is the provision of a portable practice putting device wherein one or both of the end portions optionally include a floor orientation arrangement that facilitates in the proper orientation of the housing relative to the putting mat and floor once the putting mat is fully unrolled from the housing.

In another and/or alternative non-limiting object of the present disclosure is the provision of a portable practice putting device wherein the housing includes a ball well that is configured to receive a golf ball that has moved past the back end on the putting mat or a golf ball that has fallen through an optional golf ball opening that is located at or near the back-end portion of the putting mat. The golf ball opening can be spaced equally between the side edges of the putting mat, or be spaced closer to one side of the putting mat than the other side. The golf ball opening is generally circular shaped; however, other shapes can be used (e.g., oval, triangular, square, polygonal, etc.). The cross-sectional size of the golf ball opening is generally greater than the maximum cross-sectional area of the golf ball. In one non-limiting embodiment, the cross-sectional size of the golf ball opening is 1.1 to 5 times greater (and all values and ranges therebetween) than the maximum cross-sectional area of the golf ball. In another non-limiting embodiment, the shape and size of the golf ball opening can be the same or smaller than a PGA regulation shaped and size golf hole. The golf hole opening is generally spaced from the rear end of the putting mat (e.g., spaced 0.1-6 inches and all values and ranges therebetween) from the rear end of the putting mat. Generally, the golf hole opening is spaced from the sides of the putting mat.

In another and/or alternative non-limiting object of the present disclosure is the provision of a portable practice putting device wherein the arcuate rear flange forms all of a portion of the ball well.

In another and/or alternative non-limiting object of the present disclosure is the provision of a portable practice putting device wherein the bottom portion of the flat mount surface and the inner surface of the arcuate rear flange form 10-100% of the surface of the ball well that is located below the back edge of the flat mount surface or the back-end portion of the putting mat.

In another and/or alternative non-limiting object of the present disclosure is the provision of a portable practice putting device wherein the ball well includes a bottom sloped surface to cause a ball that has fallen into the ball well to roll away from one of the end portions and toward the other end portion.

In another and/or alternative non-limiting object of the present disclosure is the provision of a portable practice putting device wherein the sloped surface of the putting mat at the end portion of the putting mat when the putting mat is fully unrolled from the housing can function as a ball return when the golf ball does not pass through the opening in the putting mat or pass over the back end of the putting mat and fall into the ball well.

In another and/or alternative non-limiting object of the present disclosure is the provision of a portable practice putting device wherein the side ball return arrangement is configured to cause a golf ball that has fallen into the ball well (e.g., pass through the opening in the putting mat and falls into the ball well, the golf ball moves off the back end of the putting matt and into the ball well, etc.) to at least partially return to a location that is near the front end portion of the putting mat.

In another and/or alternative non-limiting object of the present disclosure is the provision of a portable practice putting device wherein the ball well is configured to capture all golf balls that pass through the opening in the putting mat and falls into the ball well, or the golf ball moves off the back end of the putting matt and into the ball well.

In another and/or alternative non-limiting object of the present disclosure is the provision of a portable practice putting device wherein a return opening that allows the golf ball to pass through the return opening and into the side ball return arrangement.

In another and/or alternative non-limiting object of the present disclosure is the provision of a portable practice putting device wherein the front-end portion of the side ball return arrangement is connected to one of the end portions of the housing.

In another and/or alternative non-limiting object of the present disclosure is the provision of a portable practice putting device wherein the front portion of the side ball return arrangement is elevated above a floor surface when the housing is positioned on the floor surface and the putting mat is fully unrolled from the housing.

In another and/or alternative non-limiting object of the present disclosure is the provision of a portable practice putting device wherein the front-end portion of the side ball return arrangement forms a downward ramped portion of the side return arrangement to cause the golf ball to roll downwardly toward the floor surface on the downward ramp portion.

In another and/or alternative non-limiting object of the present disclosure is the provision of a portable practice putting device wherein that end portion that is connected to the side return mat includes first and second flanges and has a spacing between the first and second flanges is the same as or greater than a width of the side return mat such that the side return mat can be easily rolled on to and rolled off the end portion as the side return mat is rolled between the first and second flanges.

In another and/or alternative non-limiting object of the present disclosure is the provision of a portable practice putting device wherein when the putting mat and the side return mat are fully rolled up on the housing, the putting mat and the side return mat are spaced from one another.

In another and/or alternative non-limiting object of the present disclosure is the provision of a portable practice putting device wherein the practice putting device can optionally include one or more visual and/or audible devices to indicate a successful and/or unsuccessful put has occurred.

In another and/or alternative non-limiting object of the present disclosure is the provision of a portable practice putting device wherein at least one of the end portions includes one or more golf ball slots and/or cavities that can be used to store one or more golf balls on one or both end portions.

In another and/or alternative non-limiting object of the present disclosure is the provision of a portable practice putting device wherein putting mat rolls around the housing for compact, quick, and easy storage.

In another and/or alternative non-limiting object of the present disclosure is the provision of a portable practice putting device that is designed to roll the putting mat so as to avoid such curling issues.

In another and/or alternative non-limiting object of the present disclosure is the provision of a portable practice putting device wherein a weighted device can be used to ensure that the end of the putting mat lays flat on a floor surface.

In another and/or alternative non-limiting object of the present disclosure is the provision of a portable practice putting device that can be setup simply by rolling it out, thus very little setup is required.

In another and/or alternative non-limiting object of the present disclosure is the provision of a portable practice putting device that includes a mounted bubble level can be optionally used on the housing to indicate to a user whether the housing is sitting on flat, level on a ground surface.

In another and/or alternative non-limiting object of the present disclosure is the provision of a portable practice putting device that includes a rollable return mat that is used to return a golf ball to the user.

In another and/or alternative non-limiting object of the present disclosure is the provision of a portable practice putting device that includes a housing that includes a flange arrangement on the housing so that the return mat can be rolled up on the housing.

In another and/or alternative non-limiting object of the present disclosure is the provision of a portable practice putting device that includes an optional ball switch that is configured to activate a light, cause a sound (e.g., bell, clapping, cheer, etc.), activate a counter, raise a flag, etc. when a golf ball passes through a ball hole in the housing.

In another and/or alternative non-limiting object of the present disclosure is the provision of a portable practice putting device that includes a ball return arrangement has slopes and channels that capture the momentum of the moving golf ball to expedite the ejection of the golf ball from the housing and increase the speed that the golf ball moves down the side return mat.

In another and/or alternative non-limiting object of the present disclosure is the provision of a portable practice putting device that includes a rollable putting mat, a housing, and a side ball return arrangement; said rollable putting mat configured to be rolled and unrolled from said housing; said side return arrangement including a side return mat; said side return mat configured to be rolled and unrolled from said housing; said side return mat is a separate mat from said putting mat.

In another and/or alternative non-limiting object of the present disclosure is the provision of a portable practice putting device wherein side return mat has a) a width that is less than the width of the putting mat, b) that is the same or different from a length of said putting mat, and/or c) a thickness that is less than a thickness of said putting mat.

In another and/or alternative non-limiting object of the present disclosure is the provision of a portable practice putting device wherein a top surface of said putting mat includes markings to provide information to a user; said marking include one or more of distance markings, one or more lines along the longitudinal length of the putting mat to inform a user how straight a putted golf ball travels along said putting mat, and/or markings to indicate one or more targets on the putting mat.

In another and/or alternative non-limiting object of the present disclosure is the provision of a portable practice putting device wherein a front-end portion of said putting mat includes a weighted device to facilitate in maintaining the flatness of said front end portion of said putting mat after being unrolled from said housing.

In another and/or alternative non-limiting object of the present disclosure is the provision of a portable practice putting device wherein a front-end portion of said putting mat includes a connector used to releasably connect a top surface of said front end portion to a bottom surface of said putting mat when said putting mat is rolled onto said housing.

In another and/or alternative non-limiting object of the present disclosure is the provision of a portable practice putting device wherein said housing includes a midportion, a first end portion connected to one side of the midportion and second end portion connected to the opposite side of the midportion; a maximum cross-sectional area of said midportion is less than a maximum cross-sectional area of one or both of said first and second portions; a spacing between and interior surface of said first and second end portions is the same or greater than a width of said putting mat so that said putting mat can be rolled about said midportion and be partially or fully located between said first and second end portions when said putting mat is fully rolled up on said housing.

In another and/or alternative non-limiting object of the present disclosure is the provision of a portable practice putting device wherein said first and second end portions have a generally circular or oval shape so that said housing can be rolled on a floor surface; at least one of said first and second end portions includes a floor orientation arrangement that facilitates in proper orientation of said housing relative to said putting mat and a floor once said putting mat is fully unrolled from said housing on to the floor; said floor orientation arrangement configured to limit or prevent rocking of said housing on the floor surface.

In another and/or alternative non-limiting object of the present disclosure is the provision of a portable practice putting device wherein said midportion includes first and second arcuate landings that are located above and/or rearwardly of a location that said putting mat is connected to said midportion; said first and second arcuate landing extend inwardly toward a mid-region of said midportion; said first and second arcuate landings configured to facilitate in winding said putting mat about said midportion when said putting mat is rolled up onto said housing.

In another and/or alternative non-limiting object of the present disclosure is the provision of a portable practice putting device wherein said midportion includes an arcuate rear flange; said arcuate rear flange extends to and between two interior sides of said midportion or to first and second arcuate landings; said arcuate rear flange used to facilitate in said winding of the putting mat about said midportion when said putting mat is rolled up onto said housing.

In another and/or alternative non-limiting object of the present disclosure is the provision of a portable practice putting device wherein said midportion includes a flat mount surface that supports an end portion of said putting mat when said putting mat is secured to said housing; said flat mount surface includes an opening that is configured to allow a golf ball to pass therethrough.

In another and/or alternative non-limiting object of the present disclosure is the provision of a portable practice putting device wherein said housing includes a ball well that is configured to receive a golf ball that has moved past a back end of said putting mat or has fallen through a golf ball opening located at or near a back-end portion of said putting mat; said ball well is configured to a) temporarily retain golf balls that have fallen into said ball well, or b) cause the golf ball in said ball well to be fed said side ball return arrangement.

In another and/or alternative non-limiting object of the present disclosure is the provision of a portable practice putting device wherein said ball well includes a bottom sloped surface to cause the golf ball to roll toward said side ball return arrangement.

In another and/or alternative non-limiting object of the present disclosure is the provision of a portable practice putting device wherein said side ball return arrangement includes a return opening located in one of said first or second end portions; said return opening configured to enable a golf ball to exit said ball well and to move on to said side return mat.

In another and/or alternative non-limiting object of the present disclosure is the provision of a portable practice putting device wherein a front portion of the side ball return arrangement is elevated above a floor surface when said housing is positioned on a floor surface and said putting mat is fully unrolled from said housing; said front end portion of said side ball return arrangement forms a downward ramped portion of said side return arrangement to cause a golf ball to roll downwardly toward the floor surface on said downward ramp portion.

In another and/or alternative non-limiting object of the present disclosure is the provision of a portable practice putting device wherein an end portion of said side return mat has a) a side return mat weight, and wherein said side return mat weight is configured to facilitate in maintaining the flatness of said end portion of said side return mat after being unrolled from said housing, b) a ball stop, and wherein said ball stop is configured to inhibit or prevent a golf ball from rolling off a back end of said side return mat, and/or c) a connection arrangement, and wherein said connection arrangement is configured to releasably connect a top surface of said end portion of said side return mat to a bottom surface of said side return mat when said side return mat is rolled onto said housing.

In another and/or alternative non-limiting object of the present disclosure is the provision of a portable practice putting device wherein said side return mat includes a) a center groove to facilitate in maintaining a golf ball on side return mat as the golf ball rolls along said side return mat, and/or b) one or more side walls to facilitate in maintaining a golf ball on side return mat as the golf ball rolls along said side return mat.

In another and/or alternative non-limiting object of the present disclosure is the provision of a portable practice putting device wherein one of said first and second end portions incudes first and second flanges; a spacing between said first and second flanges is the same as or greater than a width of said side return mat so that said side return mat can be easily rolled on to and rolled off one of said first and second end portions.

In another and/or alternative non-limiting object of the present disclosure is the provision of a portable practice putting device wherein at least one of said first and second end portions includes one or more golf ball slots and/or cavities that can be used to store one or more golf balls on said at least one of said first and second end portions.

In another and/or alternative non-limiting object of the present disclosure is the provision of a portable practice putting device wherein said housing includes a bubble level used to indicate to a user whether said housing is sitting on flat, level on a ground surface.

In another and/or alternative non-limiting object of the present disclosure is the provision of a portable practice putting device wherein said housing includes one or more of a light system, sound arrangement, counter arrangement, and/or flag raising arrangement that is used to indicate when a golf ball passes through a ball hole in said housing.

Other objects, advantages, and novel features of the present invention will become apparent from the following detailed description of the invention when considered in conjunction with the accompanying drawings.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF NON-LIMITING EMBODIMENTS

Figure 1:
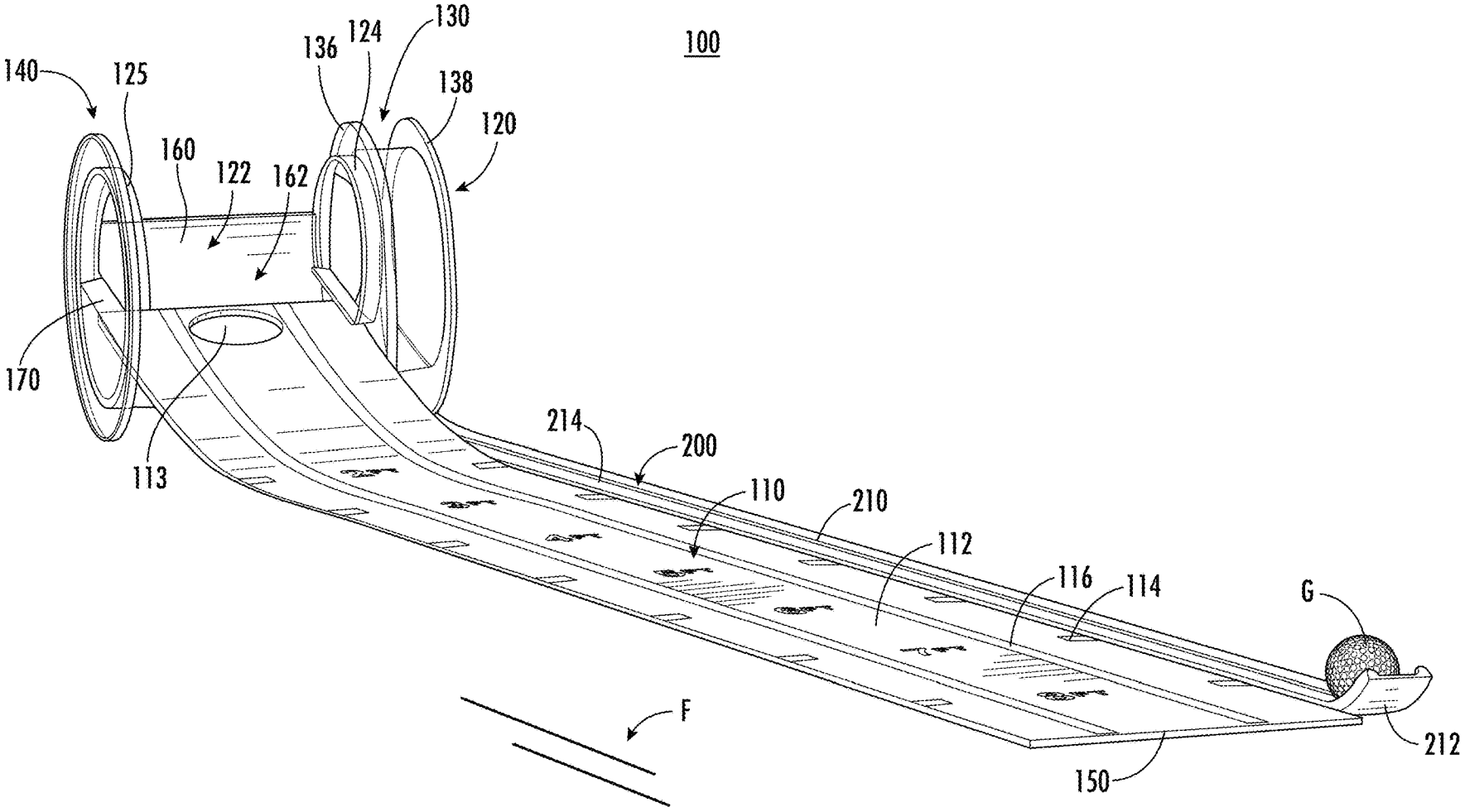
FIG. 1 is a front perspective view of one non-limiting practice putting device in accordance with the present disclosure.
Figure 2:
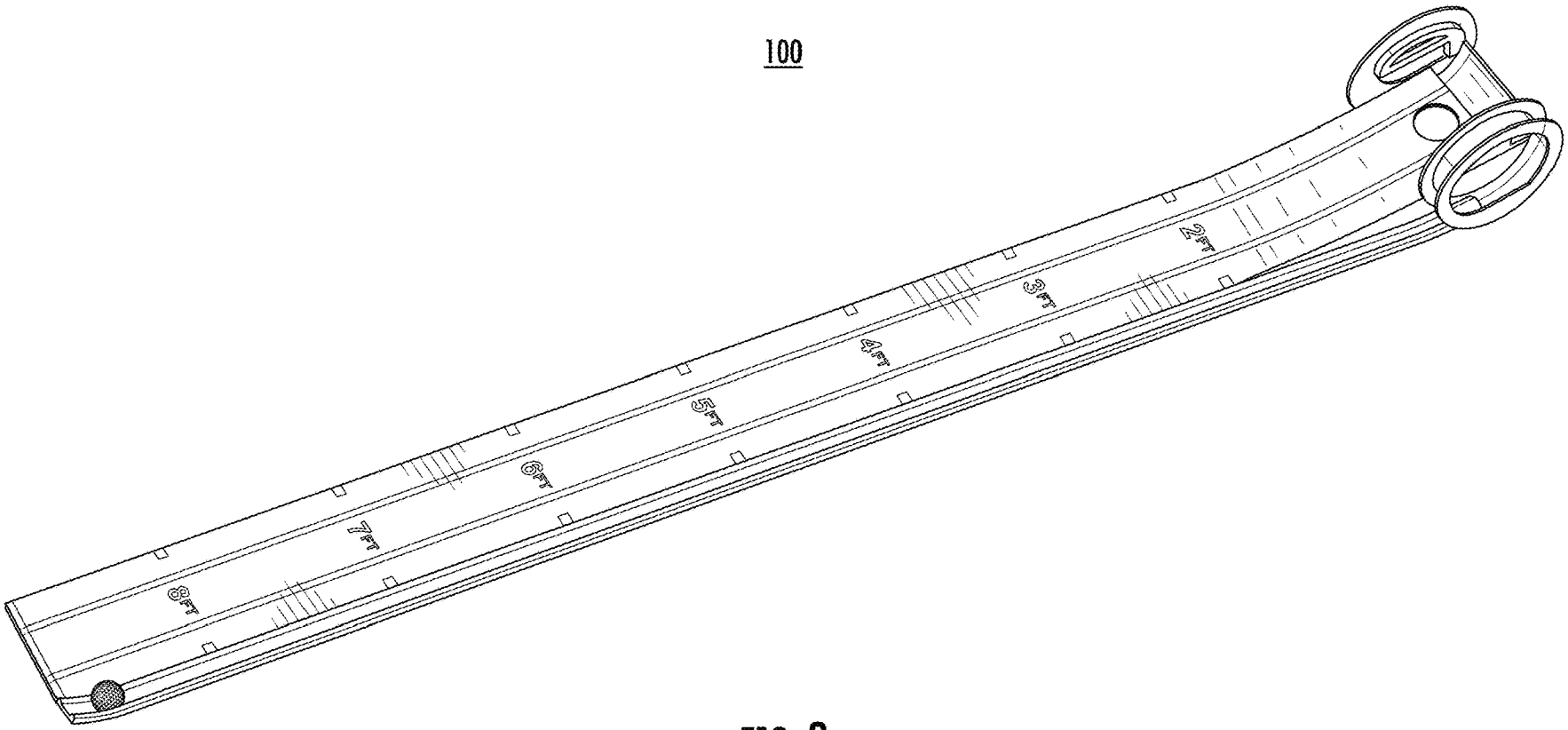
FIG. 2 is a side perspective view of the practice putting device of FIG. 1.
Figure 3:
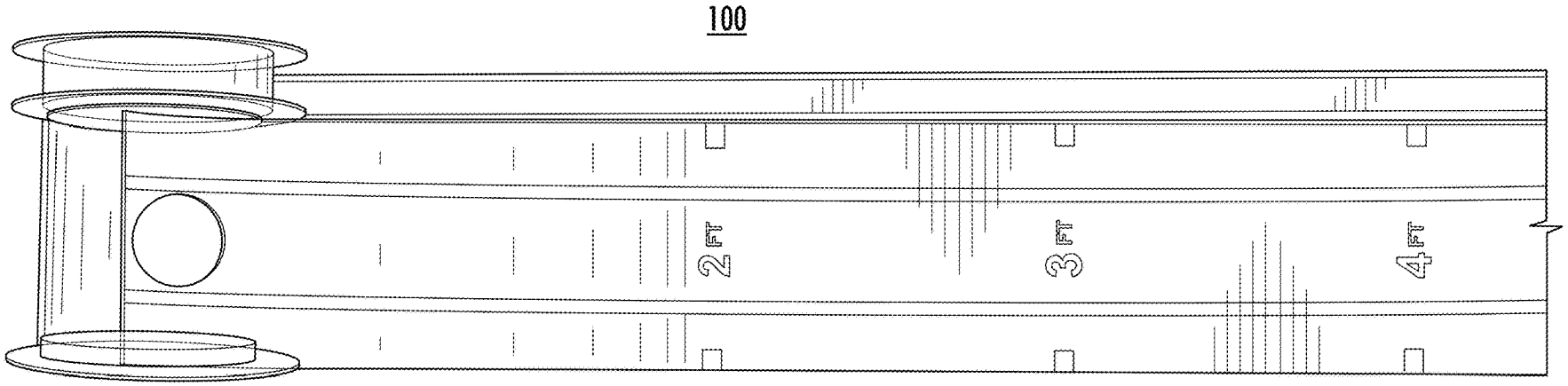
FIG. 3 is a top plan view of a portion of the practice putting device of FIG. 1.

A more complete understanding of the articles/devices, processes and components disclosed herein can be obtained by reference to the accompanying drawings. These figures are merely schematic representations based on convenience and the ease of demonstrating the present disclosure and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any unavoidable impurities that might result therefrom, and excludes other ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

The terms "about" and "approximately" may be used to include any numerical value that can vary without changing the basic function of that value. When used with a range, "about" and "approximately" also disclose the range defined by the absolute values of the two endpoints, e.g., "about 2 to about 4" also discloses the range "from 2 to 4." Generally, the terms "about" and "approximately" may refer to plus or minus 10% of the indicated number.

Referring now to the drawings, wherein the showings are for the purpose of illustrating non-limiting embodiments of the disclosure only and not for the purpose of limiting the same, there is illustrated in FIGS. 1-13 a practice putting device in accordance with the present disclosure.

The practice putting device 100 in accordance with the present disclosure includes a rollable putting mat 110, a housing 120, and ball return arrangement 200.

The putting mat 110 can be formed of any type of flexible material (e.g., fabric, plastic, rubber, polyurethane foam, PVC, etc.). The putting mat 110 is configured to be rolled and unroller multiples times without damaging the putting mat.

The putting mat 110 can be formed of a material that has little or no memory so that after the putting mat is unrolled, the putting mat lays flat on a flat floor surface F.

The length and width of the putting mat 110 is non-limiting. The length of the putting mat is generally 3-15 feet. The width of the putting mat is generally 0.4-3 feet. The thickness of the putting mat is generally 0.05-0.75 inches. The thickness and material used to form the putting mat is generally selected so that the putting mat can be easily rolled on the housing and unrolled from the housing. Generally, the thickness along the 70-100% of the longitudinal length of the putting mat and 70-100% of the width of the putting mat remains constant. The longitudinal sides along the longitudinal length of the putting mat are generally parallel to one another along 70-100% of the longitudinal length of the putting mat. The thickness of the putting mat along the longitudinal length of the putting mat is generally constant along 70-100% of the longitudinal length of the putting mat.

The top surface 112 of the putting mat 110 can include a texture that simulates the surface of a putting green. In another non-limiting embodiment, the top surface 112 of the putting mat 112 can include one or more colors, images, designs, etc. to enhance the visual appeal of the putting mat. As illustrated in FIG. 1, the top surface 112 of the putting mat can include markings to provide information to the user when practice putting. Such marking can include distance markings 114, one or more lines 116 along the longitudinal length of the putting mat 110 to inform a user how straight the putted golf ball G travels along the putting mat, markings to indicate one or more targets on the putting mat, etc. As illustrated in FIG. 1, the top surface 112 includes a) distance markings and/or numbering 114 to indicate the distance from the golf hole opening at the end portion of the putting mat, b) two parallel lines 116 that are equal spaced from the center longitudinal axis of the putting mat, and c) a center line 118 (See FIG. 5) along the center longitudinal axis of the putting mat.

The putting mat can optionally include a weighted device 150 secured to the putting mat to facilitate in maintaining the flatness of the putting mat after being unrolled from the housing and/or to maintain the front portion of the putting mat flat on a floor surface after the putting mat is unrolled from the housing. The weighted device 150 can be a metal, plastic, composite device that is secure to the front edge of the putting mat 110. The weighted device is generally formed of a different material from the putting mat.

The weighted device 150 generally has a length along the longitudinal axis of the putting mat that generally 1-10% the longitudinal length to the putting mat.

The weighted device 150 can optionally include a connection arrangement (e.g., adhesive strip, hook and loop fastener, etc.) on the bottom surface of the weighted device to facilitate in releasably securing the bottom surface of the weighted device to a floor surface (e.g., carpet, tile floor, wood floor, ceramic floor, vinyl floor, etc.).

The top surface of the weighted device can be configured to support golf balls G prior to the placing of the golf balls on the putting mat for practice putting.

The top surface of the weighted device can optionally include one or more connectors 152 (e.g., adhesive strip, hook and loop fastener, snap, etc.) that can be used to releasably connect the weighted device to the bottom surface 111 of the putting mat 110 when the putting mat is rolled onto the housing.

Figure 13:
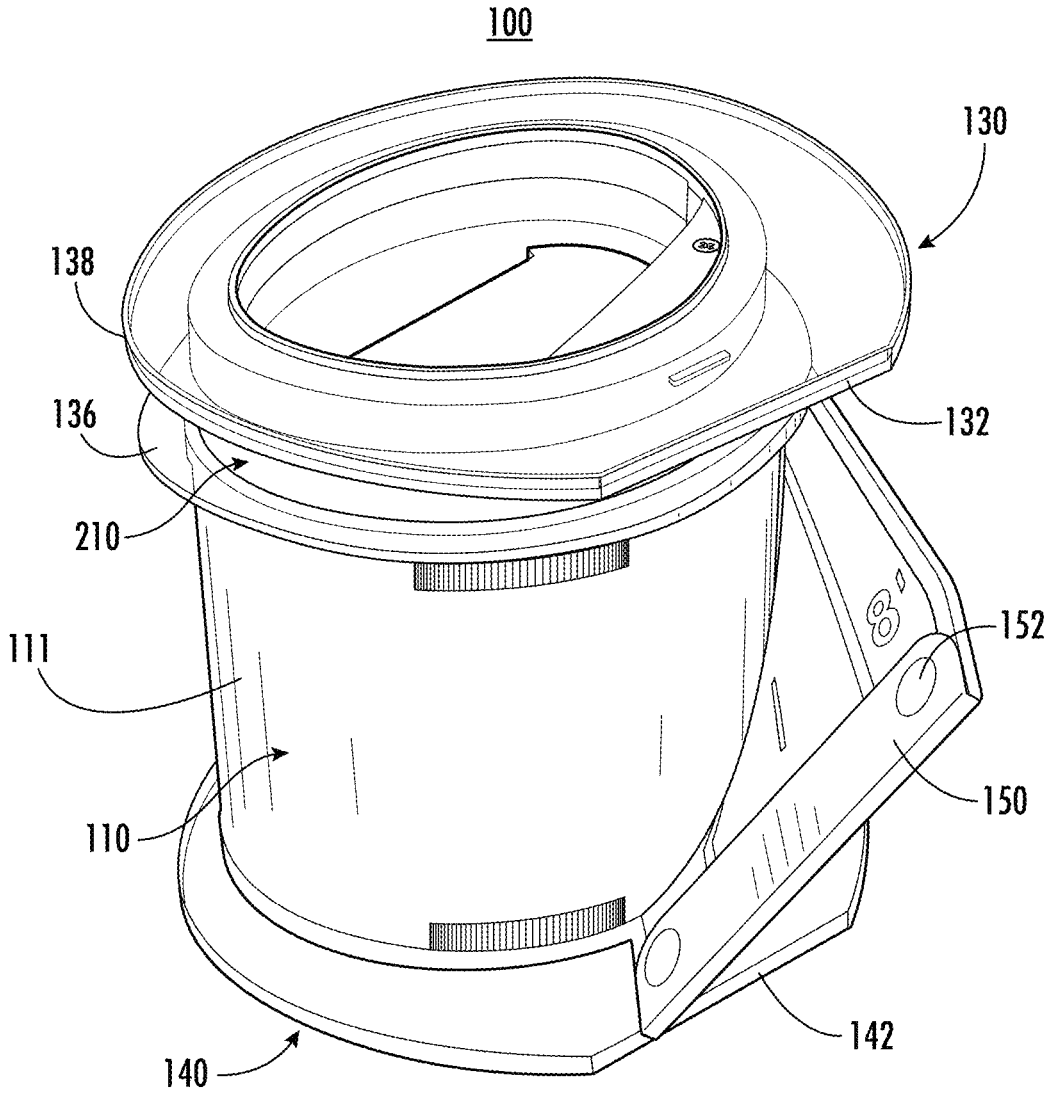
FIG. 13 illustrated the practice putting device in a stored position wherein that the putting mat and the side return mat have been rolled up on the housing.

The housing 120 is configured to enable the putting mat 110 to be rolled about a portion of the housing so that the putting mat can be stored on the housing as illustrated in FIG. 13.

Referring again to FIG. 1, the practice putting device 100 wherein the housing 120 includes a midportion 122, a first end portion 130 connected to one side of the midportion and second end portion 140 connected to the opposite side of the midportion.

The maximum cross-sectional area of the midportion is generally less than the cross-sectional area of one or both the first and second portions.

The midportion 122 include one or two arcuate landings 124, 125 that are located above and/or rearwardly of the location that the putting mat 110 when the putting mat is connected to the midportion and fully rolled out.

The arcuate landings 124, 125 are used to facilitate in the winding of the putting mat about the midportion when the putting mat is rolled up onto the housing.

Generally, the two arcuate landings 124, 125 have the same shape and/or size. As illustrated in FIG. 1, each of the arcuate landings 124, 125 extends inwardly from the side of the midportion.

The two arcuate landings generally have a constant radius of curvature. As illustrated in FIG. 1, the arcuate landings generally to not fully encircle the central axis of the midportion.

The midportion also includes an arcuate rear flange 160 that extends to and between the two interior sides of the midportion, or to the one or two arcuate landings. The arcuate rear flange 160 can also be used to facilitate in the winding of the putting mat about the midportion when the putting mat is rolled up onto the housing.

As with the arcuate landings, the arcuate rear flange can be spaced from the putting mat when the putting mat is fully unrolled from the housing.

The radius of curvature of the arcuate rear flange can optionally be the same as the radius of curvature of the two arcuate landings.

As illustrated in FIG. 1, the arcuate rear flange and two arcuate landings are spaced downwardly from the outer edge of the first and second end portions. When the putting mat is wrapped about the midportion and is fully rolled-up, 60-100% of the rolled-up putting mat is located between the first and second end portions as illustrated in FIG. 13.

The midportion of the housing includes a flat mount surface 170 wherein an end portion of the putting mat is supported thereon when secured to the housing. The end portion of the putting matt can be permanently connected or removably connected to the flat mat mount and/or other portion of the housing.

The flat mount surface includes an opening that is configured to allow a golf ball to pass therethrough. When the putting mat is secured to the housing the opening 113 in the putting mat overlies and/or encircles the opening in the flat mount surface. As can be appreciated, the size and/or shape of the opening in the putting mat and the opening in the flat mount surface can be the same. The opening in the putting mat and/or the flat mount surface is configured to receive a golf ball. The opening can be designed as a target for a user when putting. The opening is also used to allow a golf ball that passes through the opening to pass into the ball well 162.

As illustrated in FIG. 1, the back end of the putting mat and/or the back end of the flat mount surface form a rear a ball ledge that allows a ball that rolls past the ball ledge to fall into the ball well 162. The flat mount surface is illustrated as spaced from the arcuate rear flange such that a golf ball can drop between the back end of the flat mount surface and an inner surface of the arcuate rear flange.

As illustrated in FIGS. 1, 4, 7, and 8, the first and second end portions 130, 140 have a generally circular or oval shape so that the housing can be rolled on a floor surface.

The first and second end portions 130, 140 can optionally include a floor orientation arrangement 132, 142 that facilitates in the proper orientation of the housing relative to the putting mat and floor once the putting mat is fully unrolled from the housing. Such floor orientation arrangement can be used to limit or prevent the rocking of the housing on a floor surface when the end portions have a circular or oval shape. As illustrated in FIG. 13, the orientation arrangements 132, 142 are in the form of a flat portion on an outer peripheral surface of the first and second end portions 130, 140.

As illustrated in FIG. 1, the flat mount surface 170 has an upward angled orientation when the putting mat is fully unrolled from the housing and the housing is properly situated on a floor surface. Such upward angled orientation causes the rear end portion of the putting mat that is positioned on and/or secured to the flat mount surface to also have an upward angled orientation when the putting mat is fully unrolled from the housing and the housing is properly situated on a floor surface. In such a configuration, when the golf ball is caused to roll partially up the angled end portion of the putting mat, but the golf ball does not pass through the opening in the putting mat or pass over the back end of the putting mat and fall into the ball well, the golf ball is caused to roll downwardly the sloped region of the putting mat by the force of gravity and to cause the golf ball to be partially or fully fed back to the front end of the putting mat.

As discussed above, the ball well 162 is configured to receive a golf ball that has moved past the back end on the putting mat or a golf ball that has fallen through the golf ball opening that is located at or near the back-end portion of the putting mat. The ball well is configured to feed golf balls that have fallen into the ball well to the side ball return arrangement 200. The ball well generally includes a bottom sloped surface to cause a ball that has fallen into the well to roll away from the second end portion 140 and toward the first end portion 130.

The ball well includes a return opening 164 that allows the golf ball to pass through the return opening and into the side ball return arrangement 200. As discussed above, the side ball return arrangement 200 is configured to cause the golf ball to roll toward a user that is located at or near the front portion of the putting mat.

The side ball return arrangement 200 includes a side return mat 210. The front-end portion of the side return mat is connected to the first end portion 130. The return opening 164 allows the golf ball to move from the ball well 162 and onto the front portion of the side return mat. After the golf ball pass through the return opening 164, the golf ball can immediately roll onto the side return mat, or roll onto a transition region formed by the first end portion and then subsequently roll onto the side return mat. The first end portion can include a side retention flange 134 that is used to inhibit or prevent the golf ball from exiting the side of the first end portion after the golf ball passes through the return opening. The side retention flange can also be used to facilitate in guiding the golf ball onto the front portion of the side return mat.

As illustrated in FIG. 1, front portion the side ball return arrangement is elevated above a floor surface when the housing is positioned on the floor surface and the putting mat is fully unrolled from the housing. As also illustrated in FIG. 1, the front-end portion of the side ball return arrangement forms a downward ramped portion to cause the golf ball to roll downwardly toward the floor surface on the downward ramp portion. As the golf ball moves downwardly on the downward ramp portion, the golf ball increases in speed due to gravity. Once the golf ball rolls to the end of the downward ramp portion, the golf ball obtained sufficient speed to continue roll the partial of full remaining length of the side return mat.

The side return mat 210 is generally made of a flexible material. The material of the side return mat can be the same as the putting mat; however, this is not required.

The side return mat has a width that is less than the width of the putting mat. Generally, the width of the side return mat is at least 50% less than the width of the putting mat.

The length of the side return mat can be the same or less than a length of the putting mat.

Figure 5:
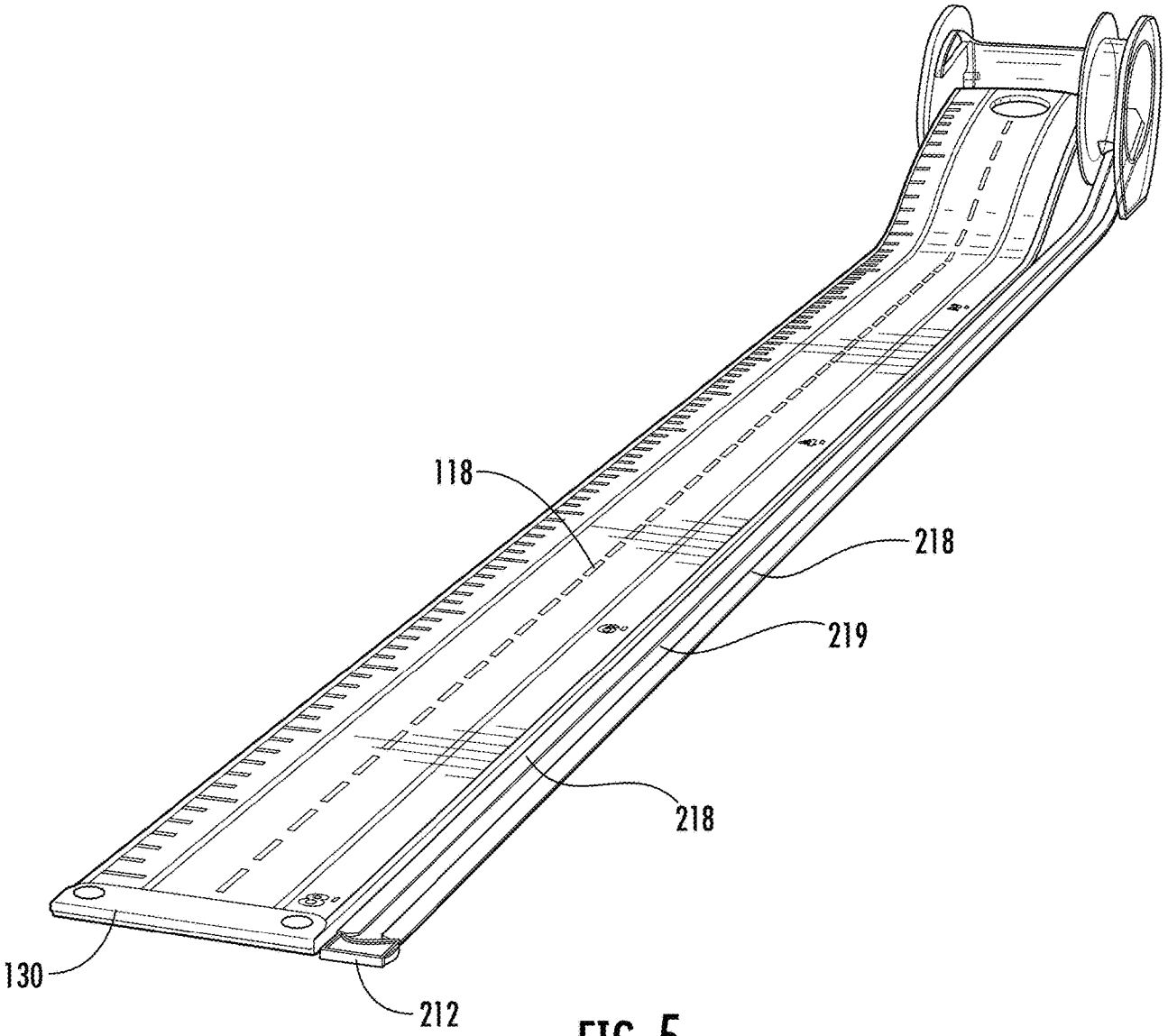
FIG. 5 is another front perspective view of the practice putting device of FIG. 1.
Figure 6:
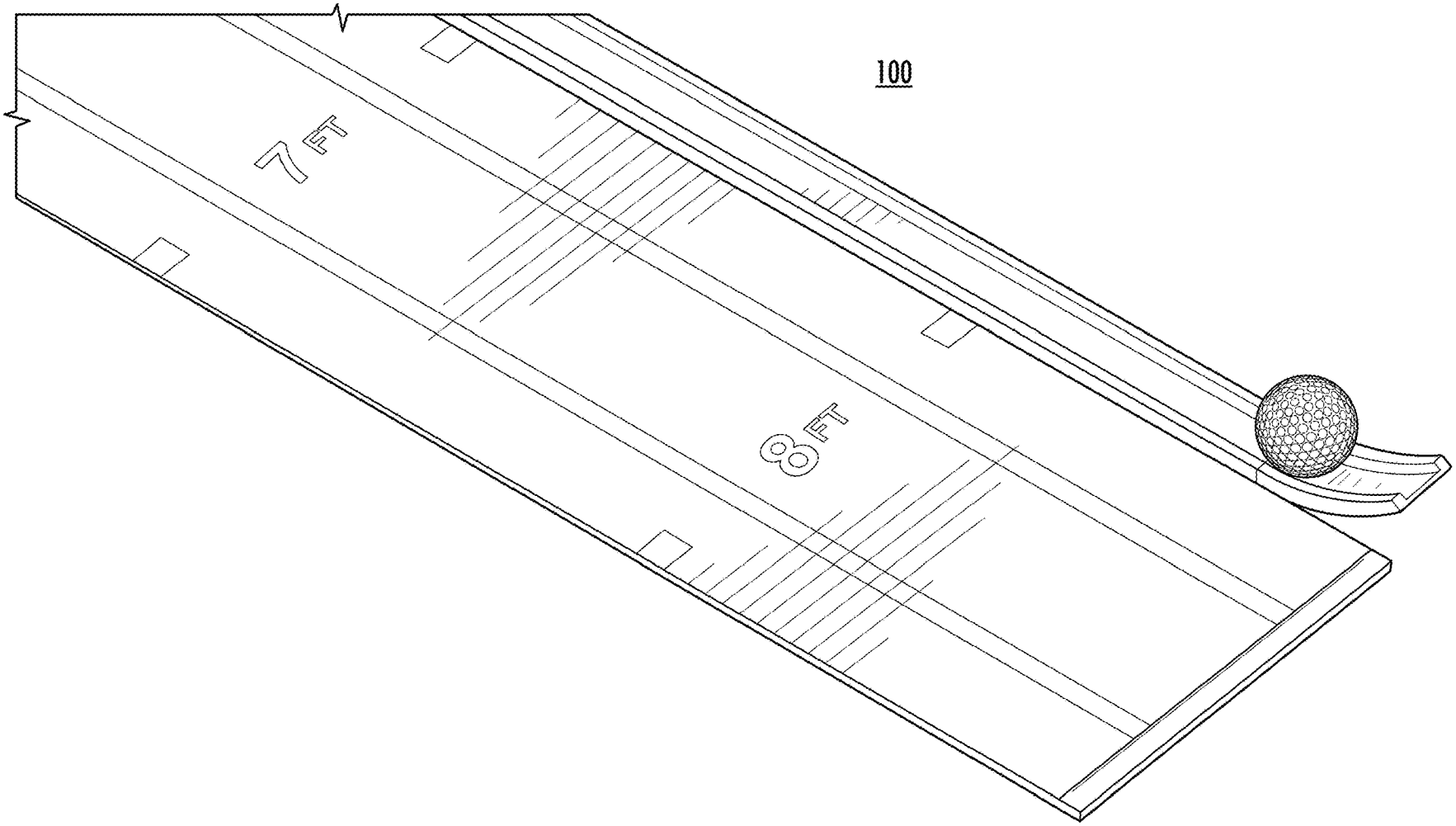
FIG. 6 is enlarged end portion view of the practice putting device of FIG. 1.
Figure 7:
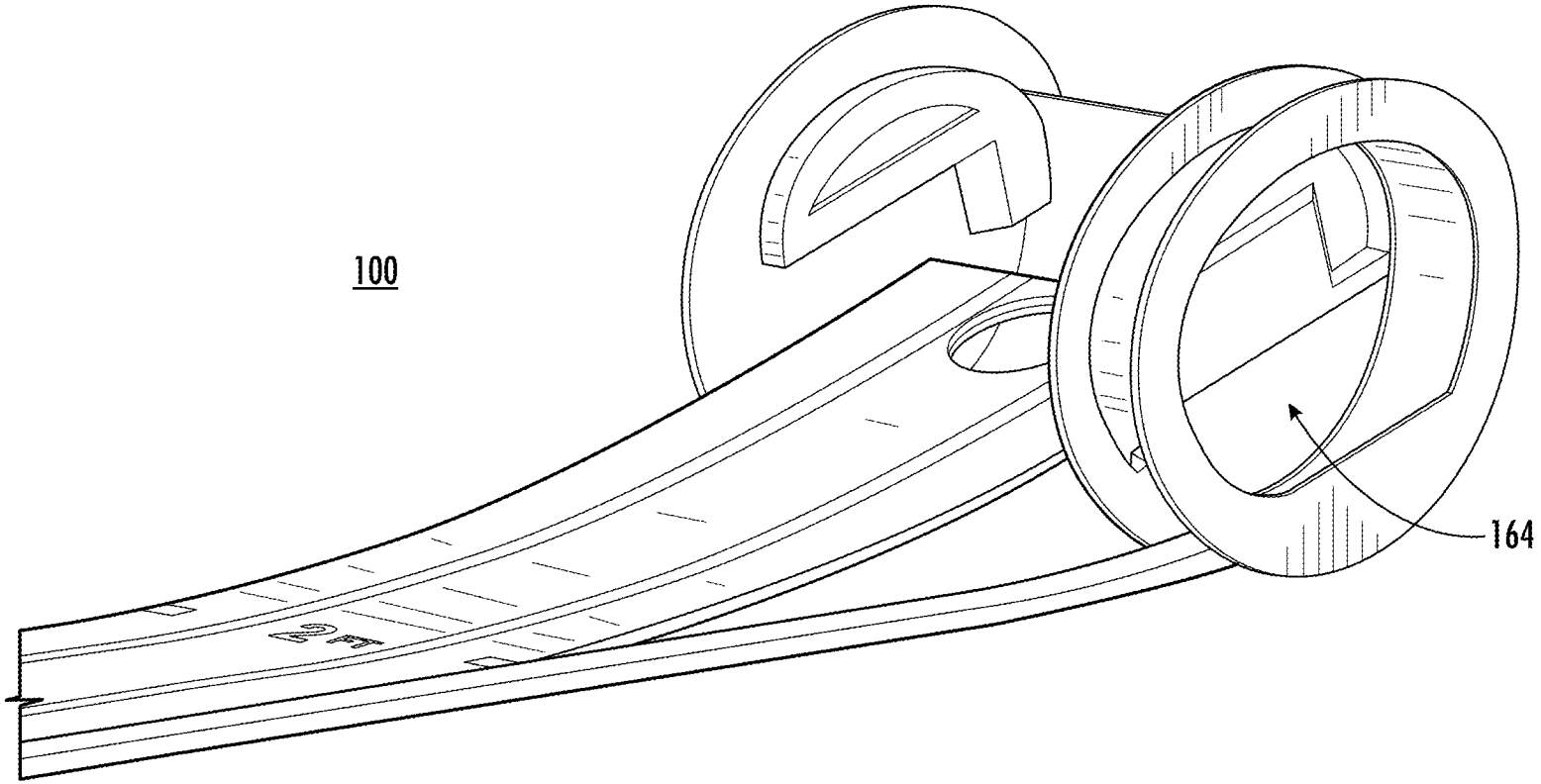
FIG. 7 is an enlarged side view of a portion of the practice putting device that illustrates a modified shape of the housing of FIG. 1.
Figure 8:
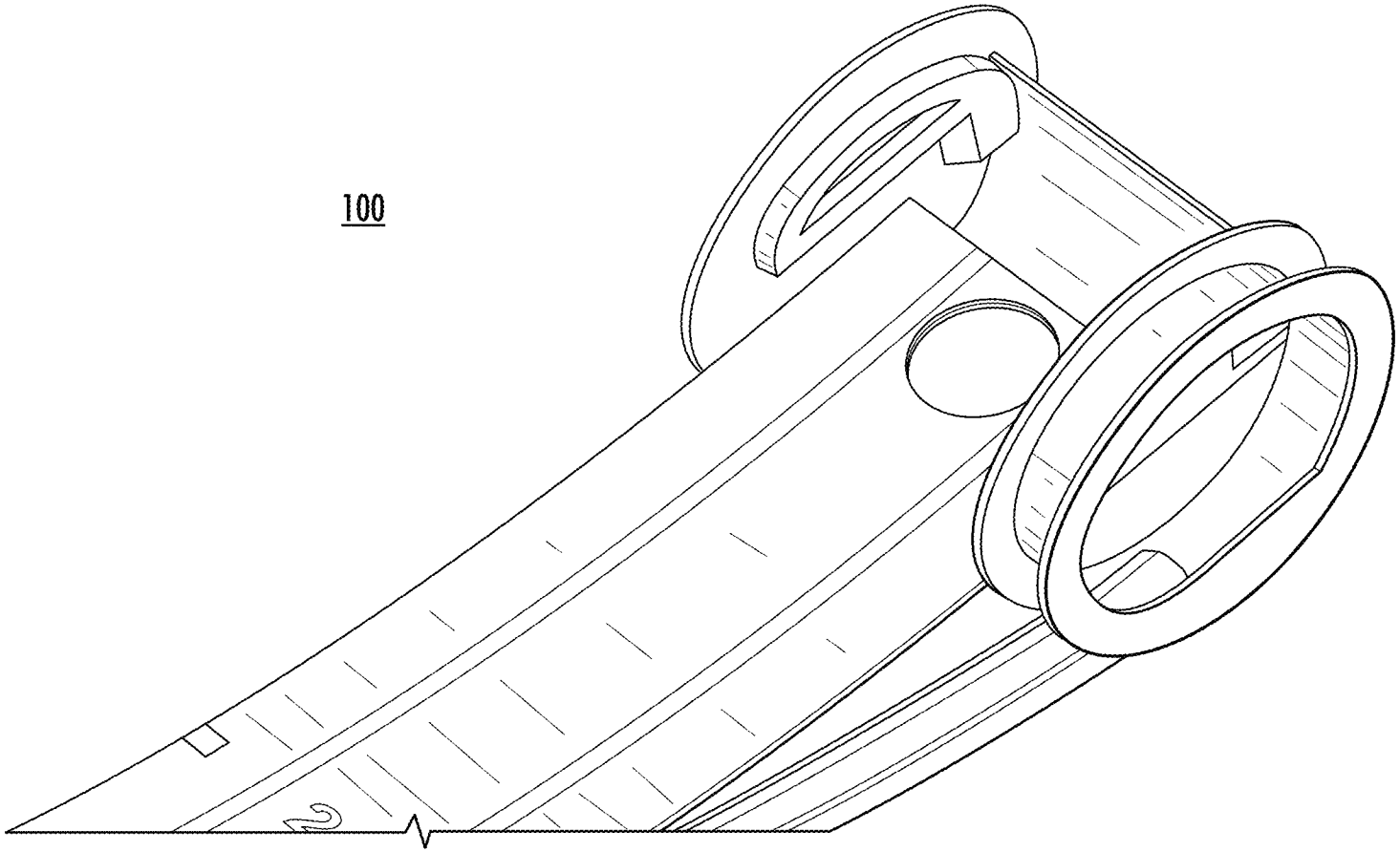
FIG. 8 is another enlarged side view of a portion of the practice putting device that illustrates a modified shape of the housing of FIG. 7.
Figure 9:
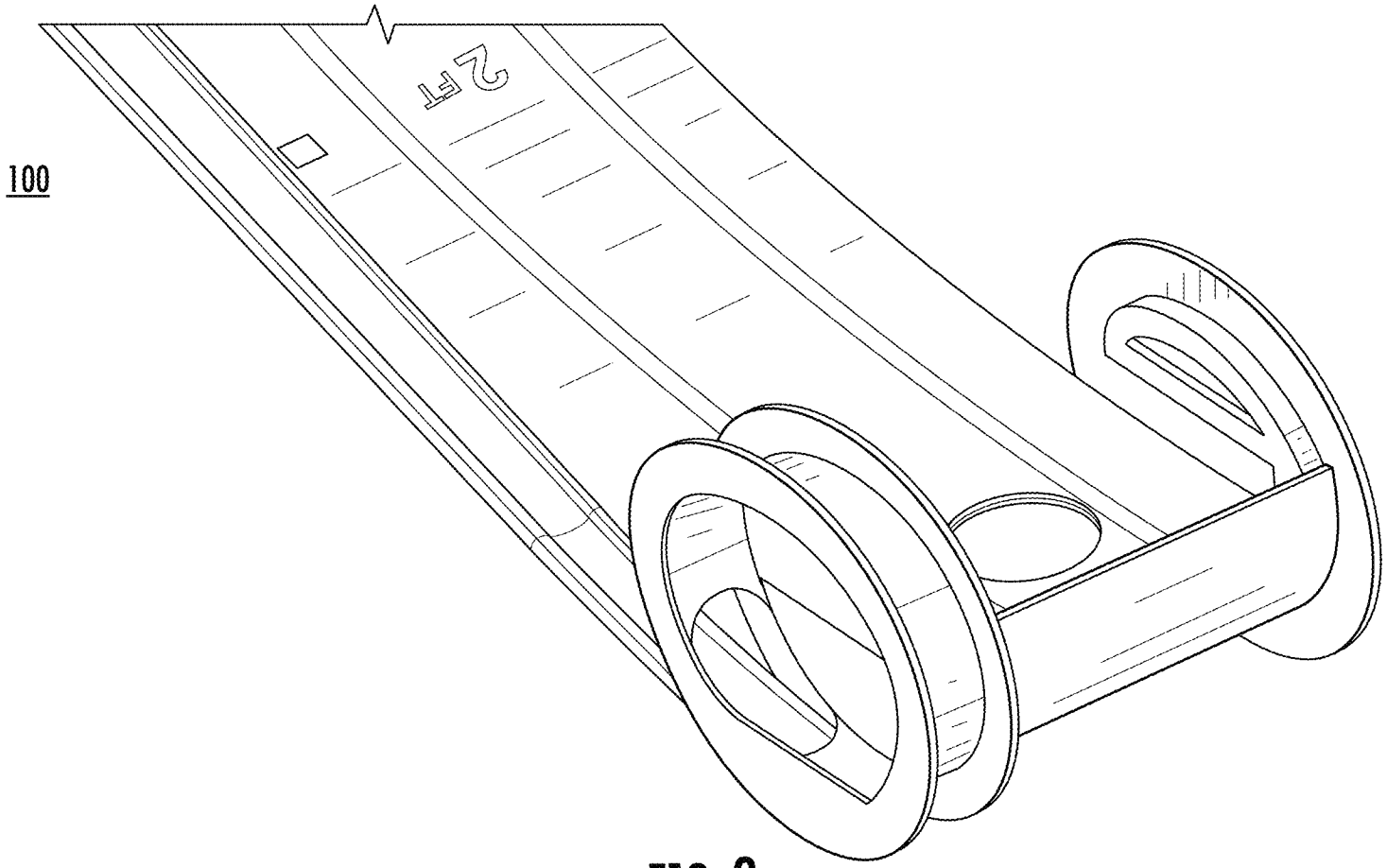
FIG. 9 is a rear perspective view of a portion of the practice putting device of FIG. 7.
Figure 10:
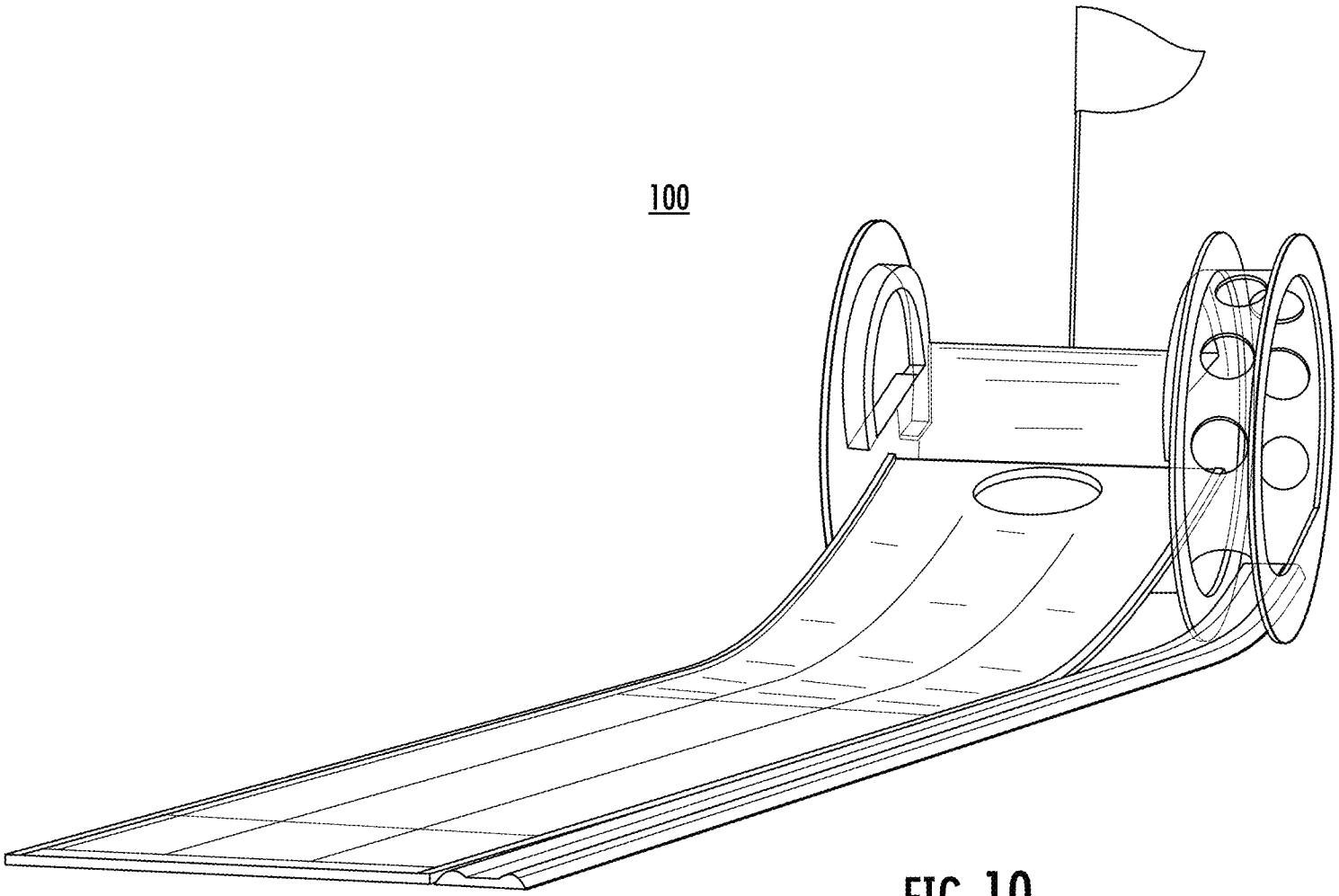
FIG. 10 is front perspective view of the practice putting device that illustrates a modified shape of the housing of FIG. 1.
Figure 11:
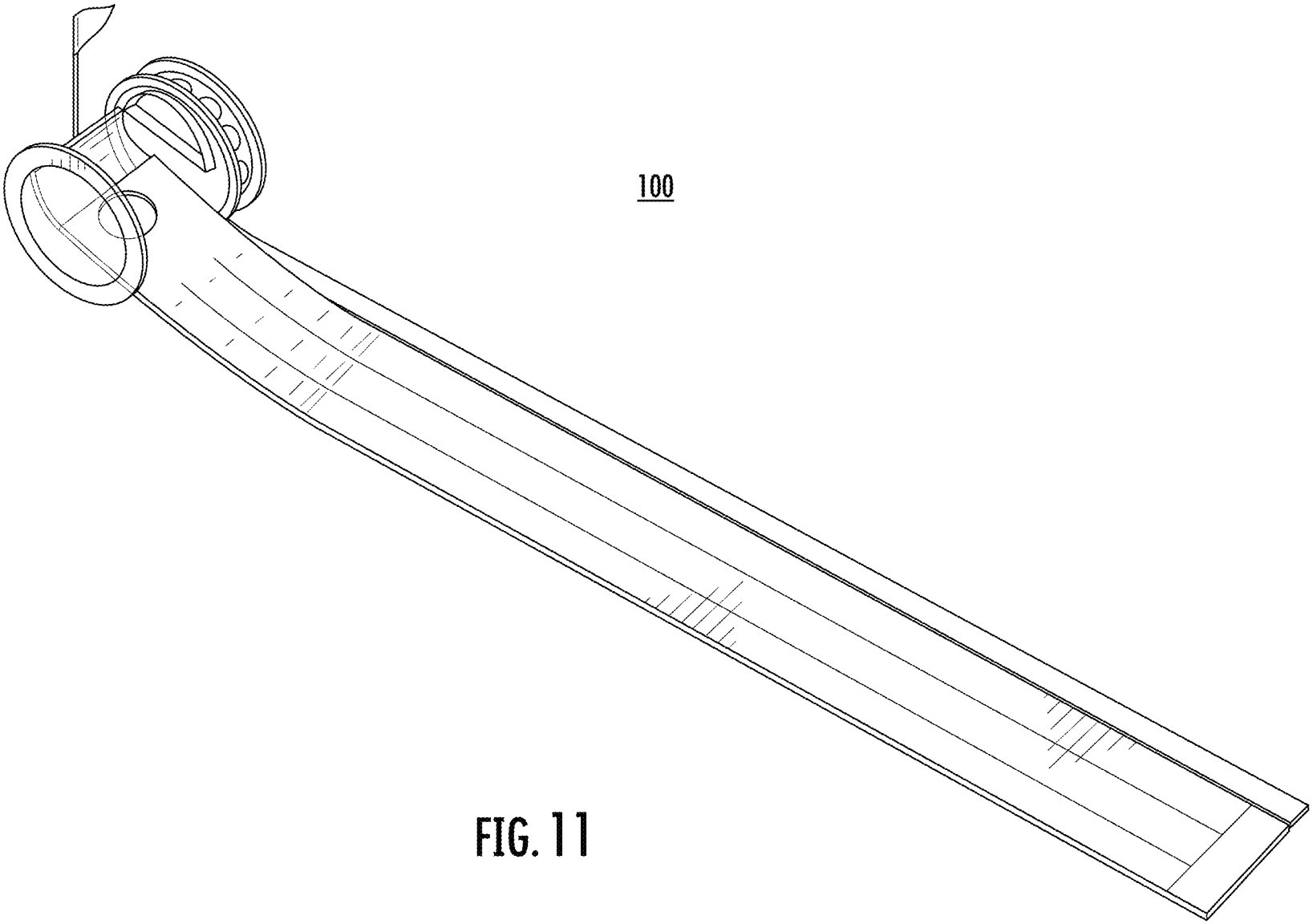
FIG. 11 is a side perspective view of the practice putting device of FIG. 10.

The end of the side return mat can optionally include a side return mat weight and/or a ball stop 212. As illustrated in FIGS. 1 and 5, two different non-limiting configurations of the weight and ball stop 212 are illustrated. FIG. 1 illustrates the ball stop having a curved-up portion to stop of the golf ball. FIG. 5 illustrates the ball stop having a ball bumper type configuration to stop the golf ball. Both of these ball stops can optionally also function as a weight if the material used is heavier than the material used to form the side return mat.

The side return mat can include a center groove 214 and/or one or more side walls 216, 218 that form a channel 219 between the side wall to facilitate in maintaining the golf ball on the side return mat as the golf ball rolls along the side return mat. As illustrated in FIG. 1, the side return mat includes a center groove. As illustrated in FIG. 5, the side return mat includes first and second side walls 216, 218 that form a central channel 219.

The thickness of the side return mat is illustrated as less than thickness of the putting mat; however, this is not required.

The side return mat is illustrated as a separate mat from the putting mat. The side return mat can be optionally releasably connected to the putting mat.

Referring again to FIG. 1, the first end portion 130 includes first and second flanges 136, 138. The spacing between the first and second flanges is the same as or greater than a width of the side return mat such that the side return mat can be easily rolled on to and rolled off the first end portion as illustrated in FIG. 13. When the side return mat is wrapped about the first end portion and is fully rolled-up, 60-100% of the side return mat is located between the first and second flanges. When the putting mat and the side return mat are fully rolled up on the housing, the putting mat and the side return mat are spaced from one another as illustrated in FIG. 13.

The end portion of the side return mat can optionally include one or more connectors (e.g., adhesive strip, hook and loop fastener, snap, etc.) that can be used to releasably connect the end portion of the side return mat to the bottom surface of the side return mat when the side return mat is rolled onto the housing.

The practice putting device can optionally include one or more visual devices and/or audible devices to indicate a successful and/or unsuccessful put has occurred. Such visual and/or audible devices can include, but are not limited to, sound generator, light system, mechanical and/or motorized movement device that raises a flag or other indicator when the golf ball passes through the ball opening, etc.

Figure 12:
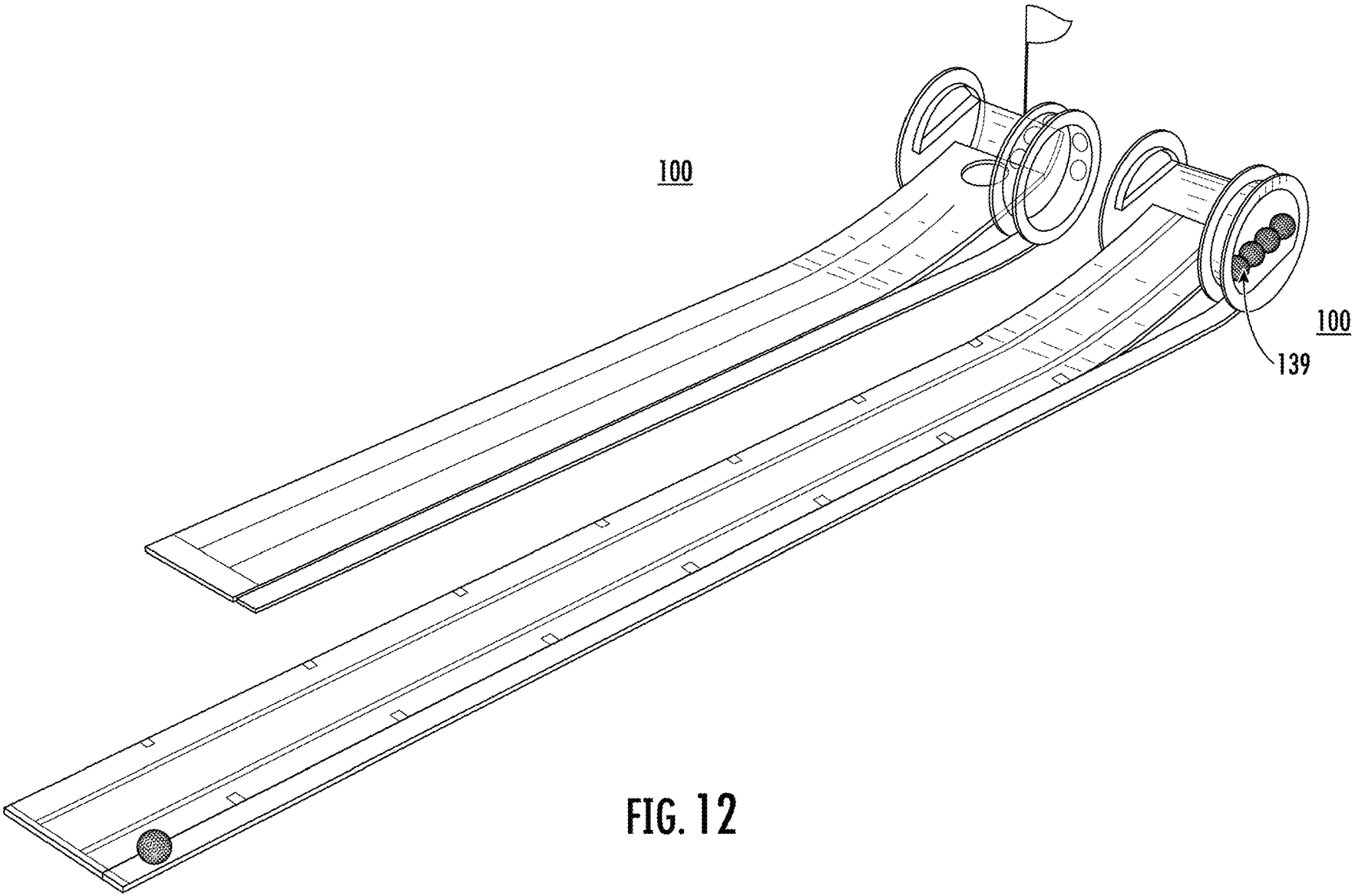
FIG. 12 illustrates front perspective view of two non-limiting practice putting device in accordance with the present disclosure.

The first end portion 130 can includes one or more golf ball slots and/or cavities 139 configured to releasably store one or more golf balls on the first end portion. The configuration of the one or more golf ball slots and/or cavities, when used, is non-limiting. As illustrated in FIG. 12, the golf ball slots and/or cavities 139 are located in a central region of the first end portion and spaced inwardly from the outer side of the first end portion.

Figure 4:
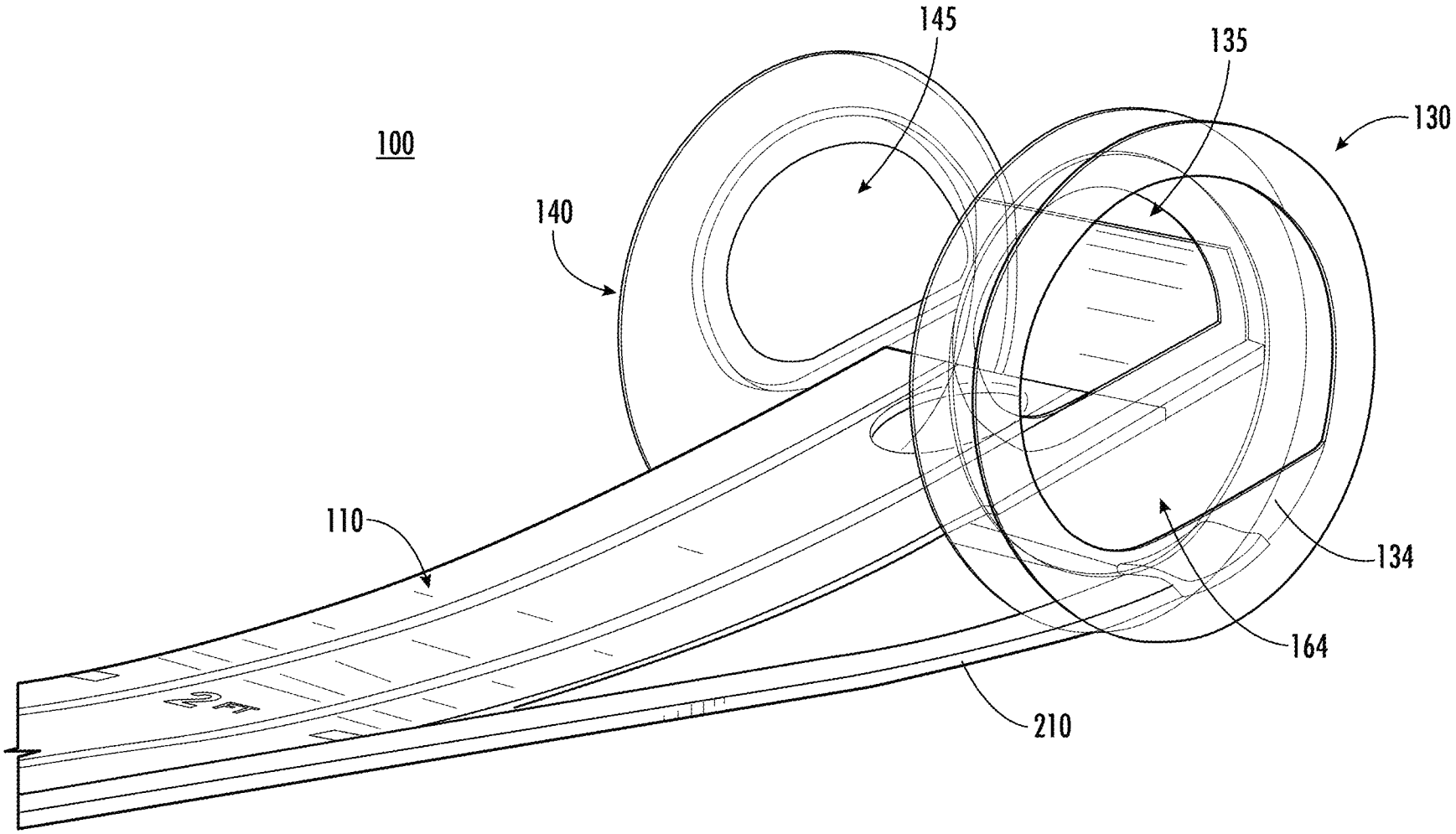
FIG. 4 is an enlarged side view of a portion of the practice putting device of FIG. 1.

As illustrated in FIG. 4, the first and second end portions can include side cavities 135, 145 that can be used to facilitate in the grasping of the housing during the rolling and unroll of the putting mat and/or side return mat.

In various embodiments disclosed herein, a single component can be replaced by multiple components and multiple components can be replaced by a single component to perform a given function or functions. Except where such substitution would not be operative, such substitution is within the intended scope of the embodiments.

Additional features and methods of operation of the practice putting device are included in the figures.

A number of implementations have been described. Nevertheless, it will be understood that various modifications may be made without departing from the spirit and scope of the claims. Accordingly, other implementations are within the scope of the following claims.

Disclosed are materials, systems, devices, methods, compositions, and components that can be used for, can be used in conjunction with, can be used in preparation for, or are products of the disclosed methods, systems, and devices. These and other components are disclosed herein, and it is understood that when combinations, subsets, interactions, groups, etc. of these components are disclosed that while specific reference of each various individual and collective combinations and permutations of these components may not be explicitly disclosed, each is specifically contemplated and described herein. For example, if a device is disclosed and discussed each and every combination and permutation of the device, and the modifications that are possible are specifically contemplated unless specifically indicated to the contrary. Likewise, any subset or combination of these is also specifically contemplated and disclosed. This concept applies to all aspects of this disclosure including, but not limited to, steps in methods using the disclosed systems or devices. Thus, if there are a variety of additional steps that can be performed, it is understood that each of these additional steps can be performed with any specific method steps or combination of method steps of the disclosed methods, and that each such combination or subset of combinations is specifically contemplated and should be considered disclosed.

To aid the Patent Office and any readers of this application and any resulting patent in interpreting the claims appended hereto, Applicant does not intend any of the appended claims or claim elements to invoke 35 U.S.C. 112(f) unless the words "means for" or "step for" are explicitly used in the particular claim.

What is claimed:

1. A practice putting device that includes:

a rollable putting mat; and a housing including a midportion about which said putting mat is rollable and unrollable, a first end portion connected to one side of said midportion, and a second end portion connected to the opposite side of said midportion;

each of said first and second end portions of said housing having an exposed outer peripheral surface shaped to be rollable directly on a floor surface to roll said putting mat up onto said housing by winding said putting mat about said midportion of said housing, and to unroll said putting mat from said housing.

2. The practice putting device as defined in claim 1, further comprising a side ball return arrangement; said side ball return arrangement including a side return mat; said side return mat is rollable up onto and unrollable from said housing; said side return mat is a separate mat from said putting mat; wherein said side return mat has a) a width that is less than the width of the putting mat, b) a length that is the same or different from a length of said putting mat, and/or c) a thickness that is less than a thickness of said putting mat.

3. The practice putting device as defined in claim 2, wherein an end portion of said side return mat has a side return mat weight, to facilitate in maintaining a flatness of said end portion of said side return mat after being unrolled from said housing and a ball stop to inhibit or prevent a golf ball from rolling off a back end of said side return mat.

4. The practice putting device as defined in claim 2, wherein said side return mat includes a) a center groove to facilitate in maintaining a golf ball on said side return mat as the golf ball rolls along said side return mat, and/or b) one or more side walls to facilitate in maintaining a golf ball on said side return mat as the golf ball rolls along said side return mat.

5. The practice putting device as defined in claim 2, wherein one of said first and second end portions incudes first and second flanges; a spacing between said first and second flanges is the same as or greater than a width of said side return mat so that said side return mat is rollable onto and rollable off one of said first and second end portions.

6. The practice putting device as defined in claim 1, wherein a top surface of said putting mat includes markings to provide information to a user; said markings include one or more of distance markings, one or more lines along a longitudinal length of the putting mat to inform a user how straight a putted golf ball travels along said putting mat, and/or markings to indicate one or more targets on the putting mat.

7. The practice putting device as defined in claim 1, wherein a front-end portion of said putting mat includes a weighted device to facilitate in maintaining a flatness of said front end portion of said putting mat after being unrolled from said housing.

8. The practice putting device as defined in claim 1, wherein a front-end portion of said putting mat includes a connector used to releasably connect a top surface of said front end portion to a bottom surface of said putting mat when said putting mat is rolled up onto said housing.

9. The practice putting device as defined in claim 1, wherein:

a maximum cross-sectional area of said midportion of said housing is less than a maximum cross-sectional area of one or both of said first and second end portions of said housing; and a spacing between said first end portion of said housing and second end portion of said housing is the same or greater than a width of said putting mat so that said putting mat is rollable about said midportion and is partially or fully located between said first and second end portions of said housing when said putting mat is fully rolled up on said housing.

10. The practice putting device as defined in claim 9, wherein the exposed outer peripheral surface of each of said first and second end portions of said housing has a generally circular or oval shape so that said outer peripheral surface of each of said first and second end portions of said housing is rollable on the floor surface; at least one of said first and second end portions of said housing includes a floor orientation arrangement, in the exposed outer peripheral surface thereof having the generally circular or oval shape, that facilitates proper orientation of said housing relative to said putting mat and the floor surface once said putting mat is fully unrolled from said housing onto the floor surface; said floor orientation arrangement limiting or preventing rocking of said housing on the floor surface once said putting mat is fully unrolled from said housing on to the floor surface.

11. The practice putting device as defined in claim 2, wherein said housing includes a ball well to receive a golf ball that has moved past a back end of said putting mat or has fallen through a golf ball opening located at or near a back-end portion of said putting mat; said ball well is configured to cause the golf ball in said ball well to be fed to said side ball return arrangement.

12. The practice putting device as defined in claim 11, wherein said side ball return arrangement includes a return opening located in one of said first or second end portions; said return opening to enable a golf ball to exit said ball well and to move on to said side return mat.

13. The practice putting device as defined in claim 11, wherein a front portion of the side ball return arrangement is elevated above the floor surface when said housing is positioned on the floor surface and said putting mat is fully unrolled from said housing; wherein said front portion of said side ball return arrangement forms a downward ramp portion of said side return arrangement to cause a golf ball to roll downwardly toward the floor surface on said downward ramp portion.

14. The practice putting device as defined in claim 1, wherein at least one of said first and second end portions includes one or more golf ball slots and/or cavities to store one or more golf balls on said at least one of said first and second end portions.

15. The practice putting device as defined in claim 1, wherein said housing includes a bubble level used to indicate to a user whether the floor surface on which said housing is sitting is level.

16. The practice putting device as defined in claim 1, wherein said outer peripheral surface of at least one of said first and second end portions of said housing includes a floor orientation arrangement that limits or prevents rocking of said housing on the floor surface once said putting mat is fully unrolled from said housing on to the floor surface.

17. The practice putting device as defined in claim 16, wherein said floor orientation arrangement comprises a flat portion on said outer peripheral surface of at least one of said first and second end portions of said housing.

18. The practice putting device as defined in claim 1, wherein said midportion of said housing includes a flat mount surface that supports an end portion of said putting mat; wherein said flat mount surface includes an opening that is aligned with an opening in said putting mat and that allows a golf ball to pass therethrough.

19. The practice putting device as defined in claim 18, wherein said flat mount surface has an upward angled orientation when said putting mat is fully unrolled from said housing and said housing is properly situated on the floor surface; said upward angled orientation causing a rear end portion of said putting mat that is positioned on and/or secured to said flat mount surface to also have an upward angled orientation when said putting mat is fully unrolled from said housing and said housing is properly situated on the floor surface.

20. The practice putting device as defined in claim 18, wherein said midportion of said housing includes a ball well that receives a golf ball that falls through said opening in said flat mount surface and said opening in said putting mat that are aligned with one another.

21. The practice putting device as defined in claim 20, further comprising a return opening located in one of said first or second end portions of said housing; said ball well including a bottom sloped surface to cause the golf ball in said ball well to roll toward said return opening; and said return opening to enable the golf ball to exit said ball well and to move onto a side return mat.

22. The practice putting device as defined in claim 20, wherein said ball well in said midportion of said housing also receives a golf ball that rolls past a back end of the putting mat.

23. A practice putting device that includes a rollable putting mat, and a housing; said putting mat rollable up onto and unrollable from said housing; wherein said housing includes a midportion, a first end portion connected to one side of said midportion, and a second end portion connected to the opposite side of said midportion; wherein said midportion includes first and second arcuate landings that are located above and/or rearwardly of a location that said putting mat is connected to said midportion; said first and second arcuate landings extend inwardly toward a mid-region of said midportion; said first and second arcuate landings to facilitate in winding said putting mat about said midportion when said putting mat is rolled up onto said housing.

24. A practice putting device that includes a rollable putting mat, and a housing; said putting mat rollable up onto and unrollable from said housing; wherein said housing includes a midportion, a first end portion connected to one side of said midportion, and a second end portion connected to the opposite side of said midportion; wherein said midportion includes an arcuate rear flange to facilitate in winding of the putting mat about said midportion when said putting mat is rolled up onto said housing.

25. A practice putting device that includes a rollable putting mat, and a housing; said putting mat rollable up onto and unrollable from said housing; wherein said housing includes a midportion, a first end portion connected to one side of said midportion, and a second end portion connected to the opposite side of said midportion; wherein said midportion of said housing includes a flat mount surface that supports an end portion of said putting mat when said putting mat is secured to said housing; wherein said flat mount surface includes an opening to allow a golf ball to pass therethrough.

26. The practice putting device as defined in claim 1, wherein said midportion of said housing includes a ball well receive a golf ball that has moved past a back end of said putting mat or has fallen through a golf ball opening located at or near a back-end portion of said putting mat; said ball well is to a) temporarily retain golf balls that have fallen into said ball well, or b) cause the golf ball in said ball well to be fed to a side ball return arrangement.

27. The practice putting device as defined in claim 26, wherein said ball well includes a bottom sloped surface to cause the golf ball in said ball well to roll toward said side ball return arrangement.

* * * * *